US007757787B2

(12) United States Patent
Mackay et al.

(10) Patent No.: US 7,757,787 B2
(45) Date of Patent: Jul. 20, 2010

(54) DRILLING AND HOLE ENLARGEMENT DEVICE

(75) Inventors: Alexander Craig Mackay, Aberdeen (GB); George Armando Espiritu, Houston, TX (US); Charles H. Dewey, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 11/669,593

(22) Filed: Jan. 31, 2007

(65) Prior Publication Data

US 2007/0163809 A1 Jul. 19, 2007

Related U.S. Application Data

(63) Continuation-in-part of application No. 11/334,195, filed on Jan. 18, 2006, now Pat. No. 7,506,703.

(51) Int. Cl.
*E21B 10/32* (2006.01)

(52) U.S. Cl. ..... 175/269; 175/263; 175/265; 175/266; 175/267; 175/288

(58) Field of Classification Search ..... 175/320, 175/53, 57, 263, 266, 271, 267, 269, 288, 175/284

See application file for complete search history.

(56) References Cited

U.S. PATENT DOCUMENTS 3,224,507 A 12/1965 Cordary et al.
3,425,500 A 2/1969 Fuchs
4,055,226 A 10/1977 Weber
4,848,490 A 7/1989 Anderson
5,318,137 A 6/1994 Johnson et al.
5,318,138 A 6/1994 Dewey et al.
5,332,048 A 7/1994 Underwood et al.
6,039,131 A 3/2000 Beaton (Continued)

FOREIGN PATENT DOCUMENTS

GB 2393461 3/2004

OTHER PUBLICATIONS

Office Action dated Mar. 20, 2008 issued in related U.S. Appl. No. 11/334,195, 8 pages.

(Continued)

*Primary Examiner*—William P Neuder
*Assistant Examiner*—Brad Harcourt
(74) *Attorney, Agent, or Firm*—Osha Liang LLP

(57) ABSTRACT

An expandable drilling apparatus includes a main body comprising a central bore and at least one axial recess configured to receive an arm assembly operable between a retracted position and an extended position, a biasing member to urge the arm assembly into the retracted position, a drive position configured to thrust the arm assembly into the extended position when in communication with drilling fluids in the central bore, a selector piston translatable between an open position and a closed position, wherein the selector piston is thrust into the open position when a pressure of the drilling fluids exceeds an activation value, wherein the drilling fluids are in communication with the drive piston when the selector piston is in the open position, and a selector spring configured to thrust the selector piston into the closed position when the pressure of the drilling fluids falls below a reset value.

20 Claims, 17 Drawing Sheets

U.S. PATENT DOCUMENTS

| | | | | |
|---|---|---|---|---|
| 6,269,893 | B1 | 8/2001 | Beaton | |
| 6,289,999 | B1 * | 9/2001 | Dewey et al. | 175/38 |
| 6,732,812 | B1 | 5/2004 | Royer | |
| 2003/0155155 | A1 | 8/2003 | Dewey et al. | |
| 2004/0206549 | A1 * | 10/2004 | Dewey et al. | 175/57 |
| 2004/0222022 | A1 * | 11/2004 | Nevlud et al. | 175/57 |
| 2006/0283636 | A1 * | 12/2006 | Reagan | 175/107 |
| 2007/0007043 | A1 * | 1/2007 | Dewey et al. | 175/75 |

OTHER PUBLICATIONS

Search and Examination Report dated Apr. 11, 2008 issued by the UK Intellectual Property Office in related Application No. GB0801834.3, 6 pages.

Office Action dated Jun. 16, 2009 issued by the Canadian Intellectual Property Office in Application No. 2,573,891, 2 pages.

* cited by examiner

DRILLING AND HOLE ENLARGEMENT DEVICE

CROSS-REFERENCE TO RELATED APPLICATIONS

The present application is a Continuation-In-Part of pending U.S. patent application Ser. No. 11/334,195, filed Jan. 18, 2006.

BACKGROUND

1. Field of the Disclosure

The present disclosure generally relates to drilling apparatus and methods. More particularly, the present disclosure relates to methods and apparatus to drill and underream subterranean wellbores. More particularly still, the present disclosure relates to methods and apparatus to drill and underream a subterranean wellbore with selectively retractable and extendable arm assemblies.

2. Background Art

In the drilling of oil and gas wells, typically concentric casing strings are installed and cemented in the borehole as drilling progresses to increasing depths. Each new casing string is supported within the previously installed casing string, thereby limiting the annular area available for the cementing operation. Further, as successively smaller diameter casing strings are suspended, the flow area for the production of oil and gas is reduced. Therefore, to increase the annular space for the cementing operation, and to increase the production flow area, it is often desirable to enlarge the borehole below the terminal end of the previously cased borehole. By enlarging the borehole, a larger annular area is provided for subsequently installing and cementing a larger casing string than would have been possible otherwise. Accordingly, by enlarging the borehole below the previously cased borehole, the bottom of the formation can be reached with comparatively larger diameter casing, thereby providing more flow area for the production of oil and gas.

Various methods have been devised for passing a drilling assembly through a cased borehole, or in conjunction with expandable casing to enlarging the borehole. One such method involves the use of an underreamer, which has basically two operative states—a closed or collapsed state, where the diameter of the tool is sufficiently small to allow the tool to pass through the existing cased borehole, and an open or partly expanded state, where one or more arms with cutters on the ends thereof extend from the body of the tool. In this latter position, the underreamer enlarges the borehole diameter as the tool is rotated and lowered in the borehole.

A "drilling type" underreamer is one that is typically used in conjunction with a conventional "pilot" drill bit positioned below (i.e. downstream of) the underreamer. Typically, the pilot bit drills the borehole to a reduced gauge, while the underreamer, positioned behind the pilot bit, simultaneously enlarges the pilot borehole to full gauge. Formerly, underreamers of this type had hinged arms with roller cone cutters attached thereto. Typical former underreamers included swing out cutter arms that pivoted at an end opposite the cutting end of the cutting arms, with the cutter arms actuated by mechanical or hydraulic forces acting on the arms to extend or retract them. Representative examples of these types of underreamers are found in U.S. Pat. Nos. 3,224,507; 3,425,500 and 4,055,226, all incorporated by reference herein. In some former designs, the pivoted arms could break and fall free of the underreamer during the drilling operation, thereby necessitating a costly and time consuming "fishing" operation to retrieve them from the borehole before drilling could continue. Accordingly, prior art underreamers may not be capable of underreaming harder rock formations, may have unacceptably slow rates of penetration, or their constructed geometries may not be capable of handling high fluid flow rates. The vacant pocket recesses also tend to fill with debris while the cutters are extended, thereby hindering the desired collapse of the arms at the conclusion of the operation. If the arms do not fully collapse, the drill string may hang up when a trip out of the borehole is attempted.

Furthermore, conventional underreamers include cutting structures that are typically formed of sections of drill bits rather than being specifically designed for the underreaming function, As a result, the cutting structures of most underreamers do not reliably underream the borehole to the desired gauge diameter. Also, adjusting the expanded diameter of a conventional underreamer requires replacement of the cutting arms with larger or smaller arms, or replacement of other components of the underreamer tool. It may even be necessary to replace the underreamer altogether with one that provides a different expanded diameter.

Moreover, many underreamers are constructed to expand when drilling fluid is pumped through the drill string at elevated pressures with no indication that the tool is in the fully expanded position. Furthermore, many expandable downhole tools expand from a retracted state to an extended state through the rupture of a shear member within the tool. Consequently, once the shear member is ruptured, pressurized fluid flow through the tool will bias the cutting arms toward expansion. As such, a return to the "original" operating state whereby the cutting arms remain retracted at pressures below the rupture pressure is no longer possible. Therefore, it would be advantageous for a drilling operator to have the ability to control not only when the underreamer expands and retracts, but also have the ability to know the status of such expansion.

Another method for enlarging a borehole below a previously cased borehole section involves the use of a winged reamer behind a conventional drill bit. In such an assembly, a conventional pilot drill bit is disposed at the distal end of the drilling assembly with the winged reamer disposed at some distance behind the drill bit. The winged reamer generally comprises a tubular body with one or more longitudinally extending "wings" or blades projecting radially outward from the tubular body. Once the winged reamer passes through any cased portions of the wellbore, the pilot bit rotates about the centerline of the drilling axis to drill a lower borehole on center in the desired trajectory of the well path, while the eccentric winged reamer follows the pilot bit and engages the formation to enlarge the pilot borehole to the desired diameter.

Yet another method for enlarging a borehole below a previously cased borehole section includes using a bi-center bit, which is a one-piece drilling structure that provides a combination underreamer and pilot bit. The pilot bit is disposed on the lowermost end of the drilling assembly, and the eccentric underreamer bit is disposed slightly above the pilot bit. Once the bi-center bit passes through any cased portions of the wellbore, the pilot bit rotates about the centerline of the drilling axis and drills a pilot borehole on center in the desired trajectory of the well path, while the eccentric underreamer bit follows the pilot bit engaging the formation to enlarge the pilot borehole to the desired final gauge. The diameter of the pilot bit is made as large as possible for stability while still being capable of passing through the cased borehole. Examples of bi-center bits may be found in U.S. Pat. Nos. 6,039,131 and 6,269,893, all incorporated by reference herein.

As described above, winged reamers and bi-center bits each include eccentric underreamer portions. Because of this design, off-center drilling is required to drill out the cement and float equipment to ensure that the eccentric underreamer portions do not damage the casing. Accordingly, it is desirable to provide an underreamer that collapses while the drilling assembly is in the casing and that expands to underream the previously drilled borehole to the desired diameter below the casing.

Further, due to directional tendency problems, these eccentric underreamer portions have difficulty reliably underreaming the borehole to the desired gauge diameter. With respect to a bi-center bit, the eccentric underreamer bit tends to cause the pilot bit to wobble and undesirably deviate off center, thereby pushing the pilot bit away from the preferred trajectory of the wellbore. A similar problem is experienced with winged reamers, which are only capable of underreaming the borehole to the desired gauge if the pilot bit remains centralized in the borehole during drilling. Accordingly, it is desirable to provide an underreamer that remains concentrically disposed within the borehole while underreaming the previously drilled borehole to the desired gauge diameter.

Furthermore, it is conventional to employ a tool known as a "stabilizer" in drilling operations. In standard boreholes, traditional stabilizers are located in the drilling assembly behind the drill bit to control and maintain the trajectory of the drill bit as drilling progresses. Traditional stabilizers control drilling in a desired direction, whether the direction is along a straight borehole or a deviated borehole.

In a conventional rotary drilling assembly, a drill bit may be mounted onto a lower stabilizer, which may be disposed approximately 5 or more feet above the bit. Typically the lower stabilizer is a fixed blade stabilizer and includes a plurality of concentric blades extending radially outwardly and azimuthally spaced around the circumference of the stabilizer housing. The outer edges of the blades are adapted to contact the wall of the existing cased borehole, thereby defining the maximum stabilizer diameter that will pass through the casing. A plurality of drill collars extends between the lower and other stabilizers in the drilling assembly. An upper stabilizer is typically positioned in the drill sting approximately 30-60 feet above the lower stabilizer. There could also be additional stabilizers above the upper stabilizer. The upper stabilizer may be either a fixed blade stabilizer or, more recently, an adjustable blade stabilizer capable of allowing its blades to collapse into the housing as the drilling assembly passes through the narrow gauge casing and subsequently expand in the borehole below. One type of adjustable concentric stabilizer is manufactured by Andergauge U.S.A., Inc., Spring, Tex. and is described in U.S. Pat. No. 4,848,490. Another type of adjustable concentric stabilizer is manufactured by Halliburton, Houston, Tex. and is described in U.S. Pat. Nos. 5,318,137, 5,318,138, and 5,332,048.

In operation, if only the lower stabilizer is provided, a "fulcrum" effect may occur because gravity displaces the lower stabilizer such that it acts as a fulcrum or pivot point for the bottom hole assembly. Alternatively, in rotary steerable and positive displacement mud motor applications, the fulcrum effect may also result from the bending loads transferred across the lower stabilizer from a directional mechanism. Namely, as drilling progresses in a deviated borehole, for example, the weight of the drill collars behind the lower stabilizer forces the stabilizer to push against the lower side of the borehole, thereby creating a fulcrum or pivot point for the drill bit. Accordingly, the drill bit tends to be lifted upwardly at a trajectory known as the build angle. Therefore, a second stabilizer is provided to offset the fulcrum effect. As the drill bit builds due to the fulcrum effect created by the lower stabilizer, the upper stabilizer engages the lower side of the borehole, thereby causing the longitudinal axis of the bit to pivot downwardly so as to drop angle. A radial change of the blades of the upper stabilizer can control the pivoting of the bit on the lower stabilizer, thereby providing a two-dimensional, gravity based steerable system to control the build or drop angle of the drilled borehole as desired.

SUMMARY OF DISCLOSURE

According to one aspect of the present disclosure, an expandable drilling apparatus includes a main body comprising a central bore and at least one axial recess configured to receive an arm assembly operable between a retracted position and an extended position. The expandable drilling apparatus also includes a biasing member to urge the arm assembly into the retracted position and a drive piston configured to thrust the arm assembly into the extended position when in communication with drilling fluids in the central bore. Furthermore, the expandable drilling apparatus includes a selector piston translatable between an open position and a closed position, wherein the selector piston is thrust into the open position when a pressure of the drilling fluids exceeds an activation value, wherein the drilling fluids are in communication with the drive piston when the selector piston is in the open position. Furthermore, the expandable drilling apparatus includes a selector spring configured to thrust the selector piston into the closed position when the pressure of the drilling fluids falls below a reset value.

According to another aspect of the present disclosure, an expandable drilling apparatus connected to a drillstring includes a cutting head disposed upon a main body, wherein the main body comprises a plurality of axial recesses adjacent to the cutting head. Further, the expandable drilling apparatus includes a plurality of arm assemblies retained within the axial recesses, wherein the arm assemblies are configured to translate from a retracted position to an extended position along a plurality of grooves formed into walls of the axial recesses, a drive piston configured to thrust the arm assemblies into the extended position when in communication with fluids flowing through the drillstring, and a selector piston configured to allow fluids flowing through the drillstring to communicate with the drive piston when an activation pressure is exceeded.

According to another aspect of the present disclosure, a method to drill a borehole including disposing a drilling assembly having expandable arm assemblies adjacent to a cutting head upon a distal end of a drillstring, drilling a pilot bore with the cutting head, underreaming the pilot bore with cutting elements of the expandable arm assemblies, stabilizing the drilling assembly with stabilizer pads of the expandable arm assemblies.

DETAILED DESCRIPTION

Embodiments disclosed herein generally relate to a drilling assemblies used in subterranean drilling. More particularly, certain embodiments disclose drilling assemblies that include a pilot bit portion and an expandable underreamer/stabilizer portion within close axial proximity to one another to simultaneously underream a pilot bore. Further, selected embodiments disclose a flow switch to actuate the expansion of the expandable underreamer/stabilizer portion, such that an operator may discern with an increased degree of accuracy whether the drilling assembly is fully expanded or retracted. Further, selected embodiments disclose an expandable drilling assembly capable of being reset to its original condition following expansion while remaining downhole. Furthermore, selected embodiments disclose an arrangement for an expandable stabilizer/cutter assembly wherein the cutter assembly is capable of expanding into the formation ahead of the stabilizer. U.S. Pat. No. 6,732,812, incorporated by reference in its entirety herein, discloses an expandable downhole tool for use in a drilling assembly positioned within a wellbore.

Figure 1:
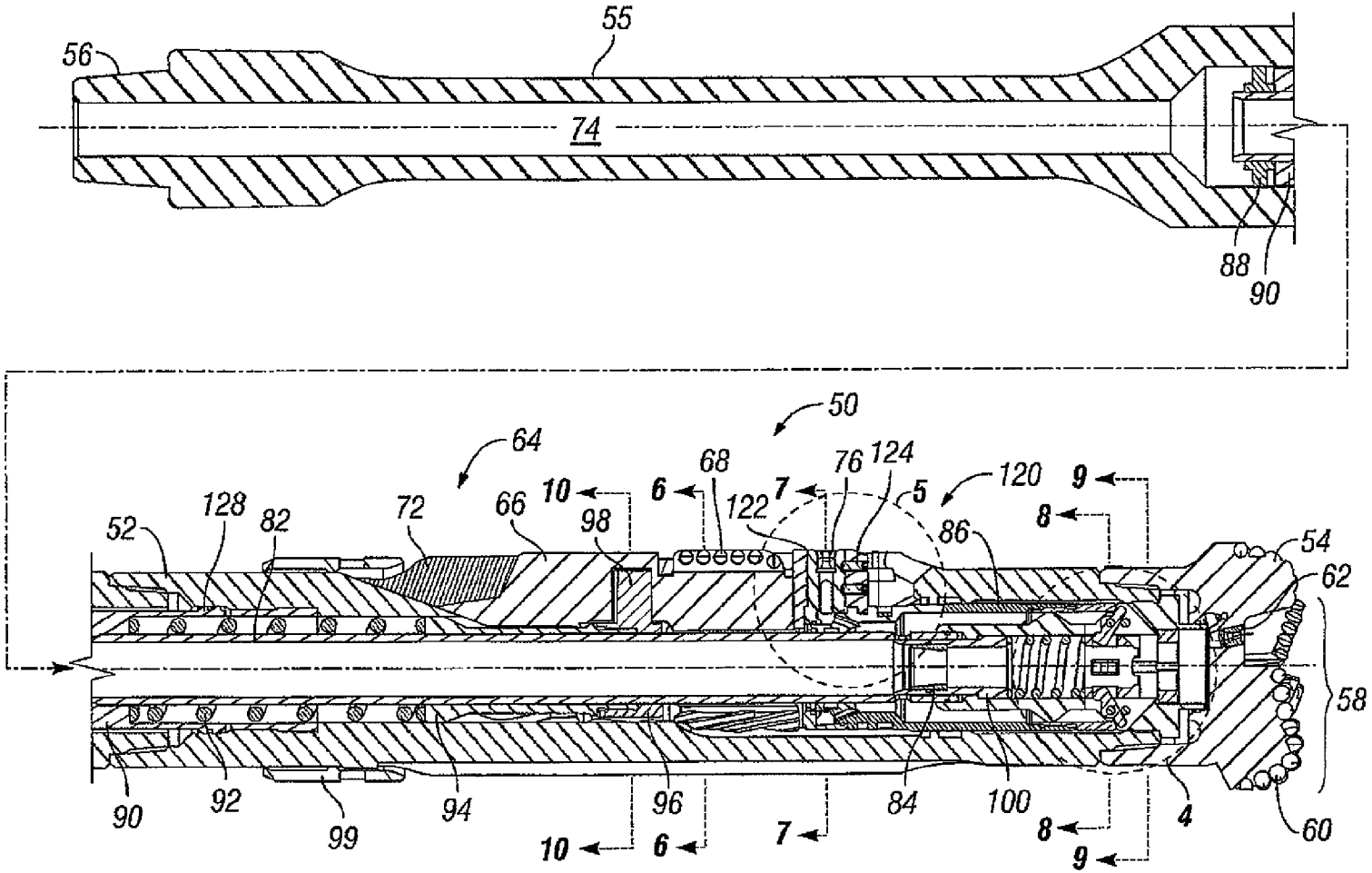
FIG. 1 is a sectioned view of a drilling assembly in a retracted position in accordance with an embodiment of the present disclosure.

Referring now to FIG. 1, a drilling assembly 50 in accordance with an embodiment disclosed herein is shown. Drilling assembly 50 is shown having a substantially tubular main body 52, a cutting head 54, a flex member 55, and a drillstring connection 56. While drillstring connection 56 is depicted as a rotary threaded connection, it should be understood by one of ordinary skill in the art that any method of connecting drilling assembly 50 with the remainder of the drillstring (not shown) may be employed, so long as rotational and axial loads may be transmitted therethrough.

It should be understood that the term "drillstring" may be used to describe any apparatus or assembly that may be used to thrust and rotate drilling assembly 50. Particularly, the drillstring may comprise mud motors, bent subs, rotary steerable systems, drill pipe rotated from the surface, coiled tubing or any other drilling mechanism known to one of ordinary skill. Furthermore, it should be understood that the drillstring may include additional components (e.g. MWD/LWD tools, stabilizers, and weighted drill collars, etc.) as needed to perform various downhole tasks.

Cutting head 54 is depicted with a cutting structure 58 including a plurality of polycrystalline diamond compact ("PDC") cutters 60 and fluid nozzles 62. While drilling assembly 50 depicts a PDC cutting head 54, it should be understood that any cutting assembly known to one of ordinary skill in the art, including, but not limited to, roller-cone bits and impregnated natural diamond bits, may be used. As drilling assembly 50 is rotated and thrust into the formation, cutters 60 scrape and gouge away at the formation while fluid nozzles 62 cool, lubricate, and wash cuttings away from cutting structure 58.

Figure 14:
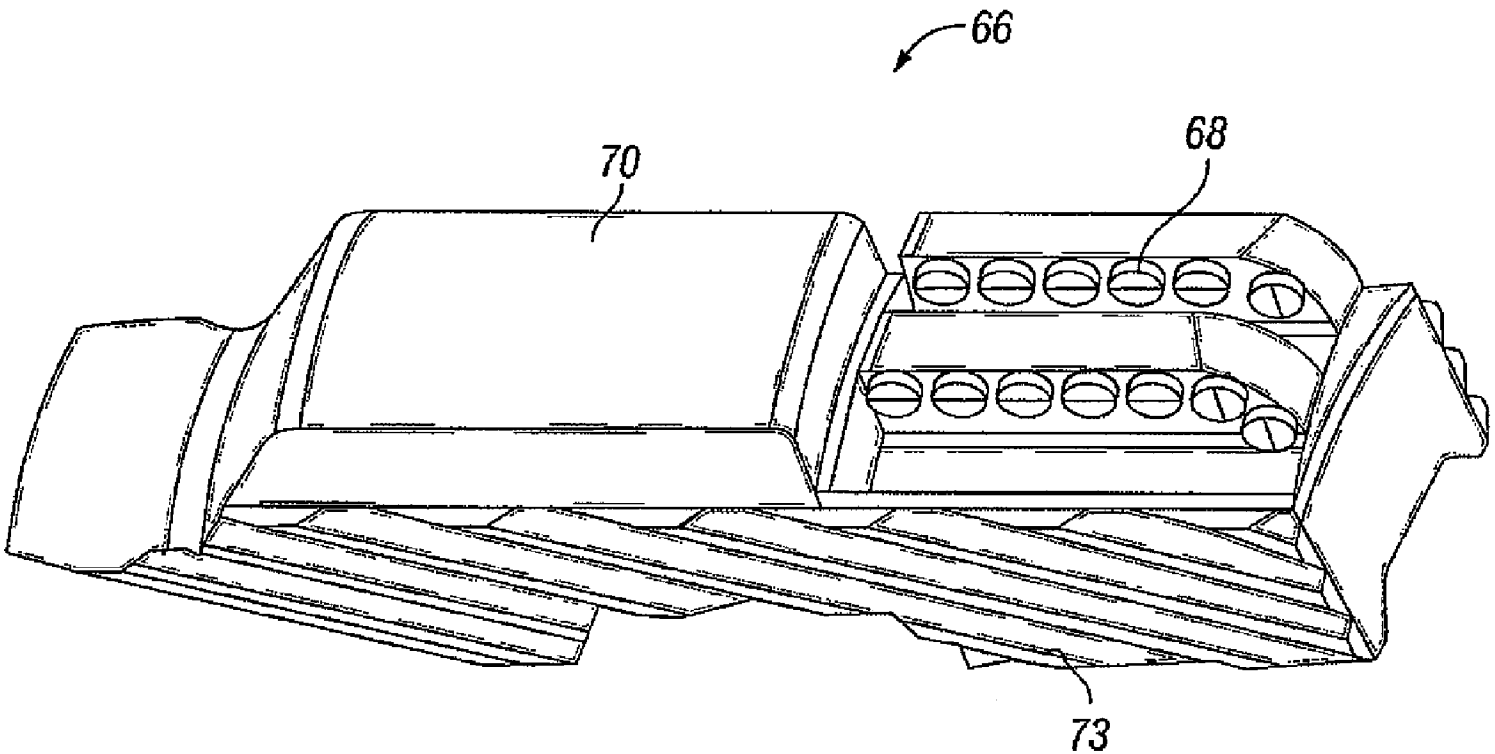
FIG. 14 is an isometric view of an arm assembly of the drilling assembly of FIGS. 1 and 11.
Figure 15:
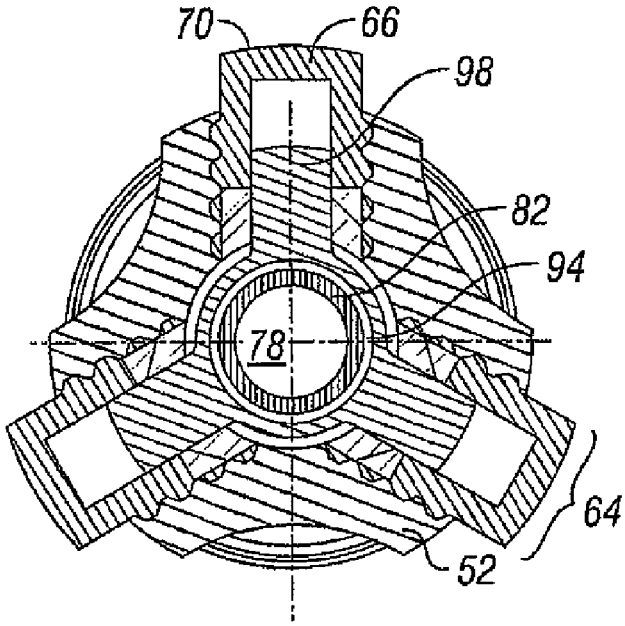
FIG. 15 is a cross-sectional view of the drilling assembly of FIG. 11 taken at 15-15.
Figure 16:
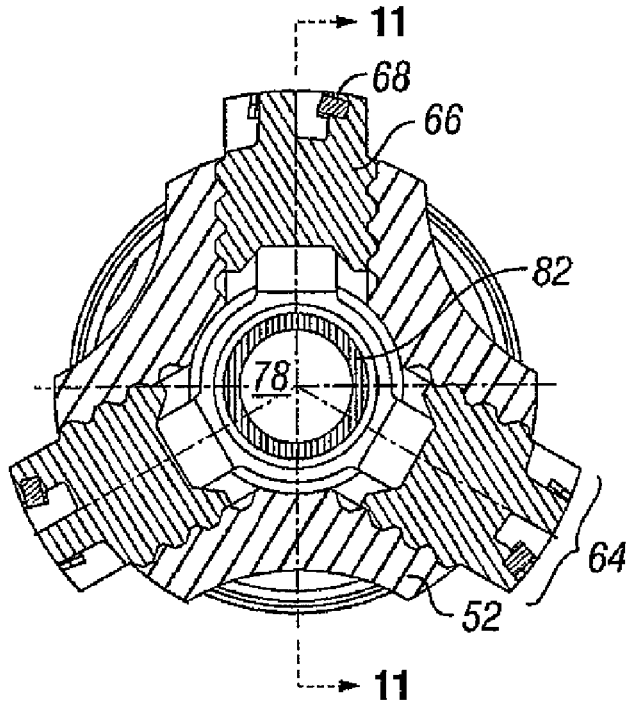
FIG. 16 is a cross-sectional view of the drilling assembly of FIG. 11 taken at 16-16.

Additionally, tubular main body 52 includes a plurality of axial recesses 64 into which arm assemblies 66 are located. Arm assemblies 66 are configured to extend from a retracted (shown) position to an extended position (FIG. 11) when cutting elements 68 and stabilizer pads 70 of arm assemblies are to be engaged with the formation. Arm assemblies 66 travel from their retracted position to their extended position along a plurality of grooves 72 within the wall of axial recesses 64. Corresponding grooves (73 of FIG. 14) along the outer profile of arm assemblies 66 engage grooves 72 and guide arm assemblies 66 as they traverse in and out of axial recesses 64.

While three arm assemblies 66 are depicted in figures of the present disclosure, it should be understood that any number of arm assemblies 66 may be employed, from a single arm assembly 66 to as many arm assemblies 66 as the size and geometry of main body 52 may accommodate. Furthermore, while each arm assembly 66 is depicted with both stabilizer pads 70 and cutting elements 68, it should be understood that arm assemblies 66 may include stabilizer pads 70, cutting elements 68, or a combination thereof in any proportion appropriate for the type of operation to be performed. Additionally, arm assembly 66 may include various sensors, measurement devices, or any other type of equipment desirably retractable and extendable from and against the borehole upon demand.

In operation, cutting structure 58 upon cutting head 54 is designed and sized to cut a pilot bore, or a bore that is large enough to allow drilling assembly 50 in its retracted (FIG. 1) state and remaining components of the drillstring to pass therethrough. In circumstances where the borehole is to be extended below a string of casing, the geometry and size of cutting structure 58 and main body 52 is such that entire drilling assembly 50 may pass clear of the casing string without becoming stuck. Once clear of the casing string or when a larger diameter borehole is desired, arm assemblies 66 are extended and cutting elements 68 disposed thereupon (in conjunction with stabilizer pads 70) underream the pilot bore to the final gauge diameter.

As disclosed, drilling assembly 50 uses hydraulic energy to extend arm assemblies 66 from and into axial recesses 64 within main body 52. Drilling fluid is a necessary component of virtually all drilling operations and is delivered downhole from the surface at elevated pressures through a bore of the drillstring. Similarly, drilling assembly 50 includes a through bore 74, through which drilling fluids flow through drillstring connection 56 and main body 52 and out fluid nozzles 62 of cutting head 54 to lubricate cutters 60. As with other downhole drilling devices, the fluid exiting the bore at the bottom of the drillstring returns to the surface along an annulus formed between the borehole and the outer profile of the drillstring and any tools attached thereto.

Because of flow restrictions and differential areas between the bore and the annulus of drillstring components, the annulus return pressure may be significantly lower than the bore supply pressure. This differential pressure between the bore and annulus is referred to as the pressure drop across the drillstring. Therefore, for every drillstring configuration, a characteristic pressure drop exists that may be measured and monitored at the surface. As such, if leaks in drill pipe connections, changes in the drillstring flowpath, or clogs within fluid pathways emerge, an operator monitoring the drillstring pressure drop from the surface will notice a change and may take action if necessary.

Similarly, drilling assembly 50 will desirably exhibit characteristic pressure drop profiles at various stages of operation downhole. When drilling with arm assemblies 66 in their retracted state within axial recesses 64, drilling assembly 50 will exhibit a pressure drop profile corresponding to that retracted state. When the operator desires to extend arm assemblies 66, the pressure and/or flow rate of drilling fluids flowing through bore 74 are increased to exceed a predetermined activation level. Once the activation level is exceeded, a flow switch activates a mechanism that will extend arm assemblies 66. Following such activation, a portion of the drilling fluids are diverted from through bore 74 of main body 52 to the annulus through a plurality of nozzles 76 located adjacent to axial recesses 64. As drilling fluids begin flowing through nozzles 76, the characteristic pressure drop of drilling assembly 50 changes to an intermediate profile such that the operator at the surface is aware the flow switch is activated and underreaming has begun.

Once arm assemblies 66 are fully extended, drilling assembly 50 is desirably constructed such that additional flow through an indication nozzle (77 of FIG. 3) results and another pressure drop profile corresponding to the extended state is exhibited. When the drilling assembly 50 exhibits the expanded characteristic pressure drop profile, an operator monitoring at the surface is aware that arm assemblies 66 have fully extended. Additionally, it is desirable that the intermediate pressure drop profile of drilling fluids remains constant throughout the extension of arm assemblies, such that the surface operator observes a step-plateau change in pressure drop profile for drilling assembly 50.

When retraction of arm assemblies 66 is desired, the operator reduces (or completely cuts off) the pressure and/or flow rate of drilling fluids through bore 74 to a level below a predetermined reset level. Once decreased to the reset level, internal biasing mechanisms retract arm assemblies 66 and shut off flow between bore 74 and nozzles 76 and 77. Alternatively, the flow of drilling fluids through bore 74 may be cut off altogether. Following retraction, flow through nozzles 76 is halted and the operator may again observe the characteristic pressure drop profile associated with the retracted state across drilling assembly 50 and know that arm assemblies 66 are fully retracted. As with the extension process, an intermediate pressure drop profile will be observed while arm assemblies 66 are in the process of retracting, but not fully retracted. Once the operator observes the "retracted" characteristic pressure drop, they may proceed to raise the pressure and/or flow rate of drilling fluids through drilling assembly 50 up to the activation level without concern for extending arm assemblies 66.

Former flow switch mechanisms, particularly those employing shear members, do not have the ability to return to their original state following activation. As such, devices (e.g., expandable reamers, stabilizers, and drill bits) employing such mechanisms must be returned to the surface for re-configuration before they may be used up to their activation levels again without undesired activation of their components. Specifically, in the case of shear members, once ruptured, they must be replaced as they may be re-activated with even minimal pressure flows therethrough extending their components. Therefore, in circumstances where pressures are accidentally raised above the activation level, the device must be retrieved and re-manufactured before operations may continue at pressure without extension. In contrast, flow switches in accordance with embodiments disclosed herein allow the operator to back off pressure and let the device reset itself, thereby saving costly hours and expense to the drilling contactor. Once reset, elevated pressure flows will not affect arm assemblies 66 until the activation level is again exceeded.

Figure 1A:
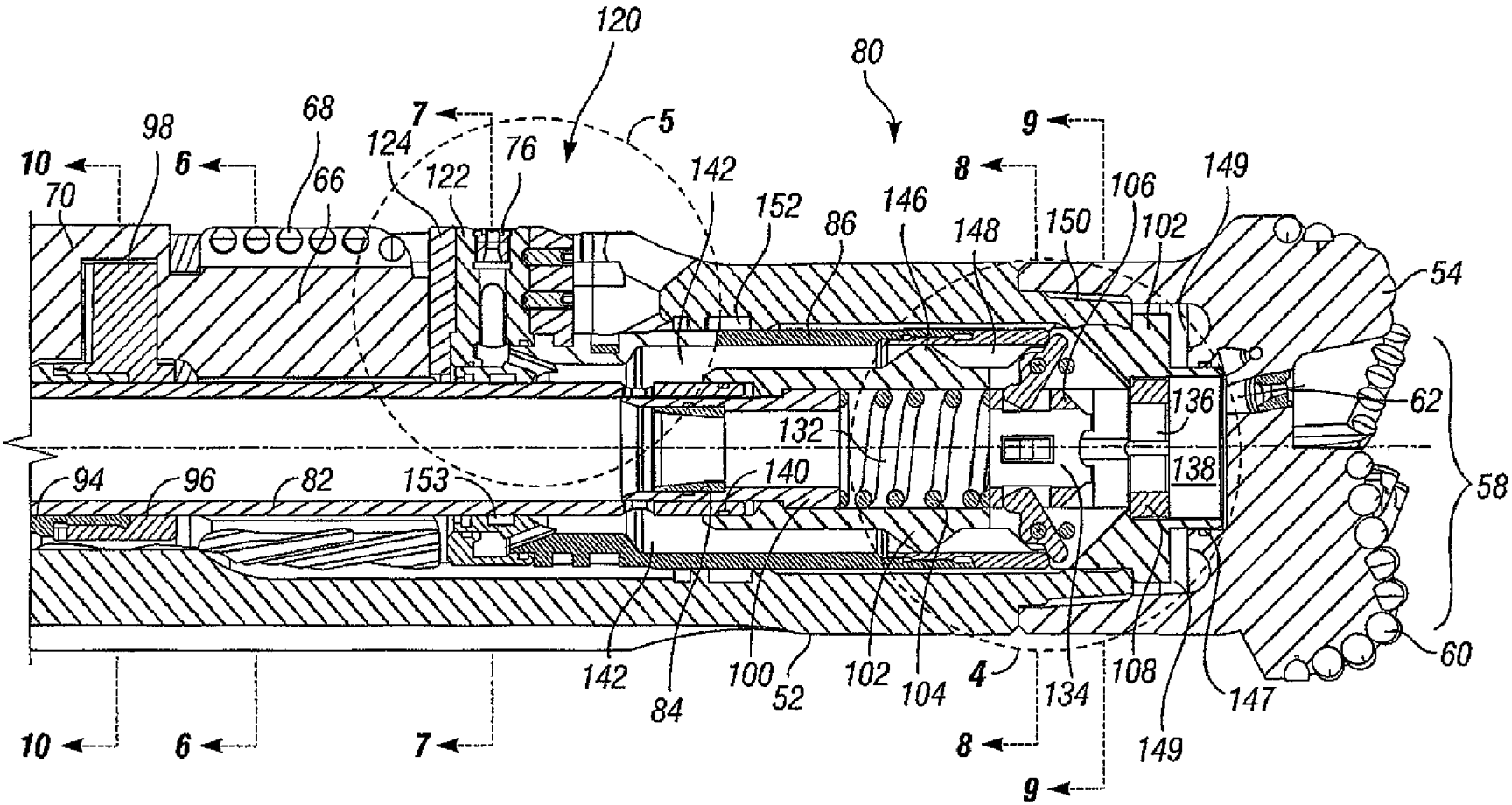
FIG. 1A is a close-up view of a portion of the drilling assembly of FIG. 1.
Figure 2:
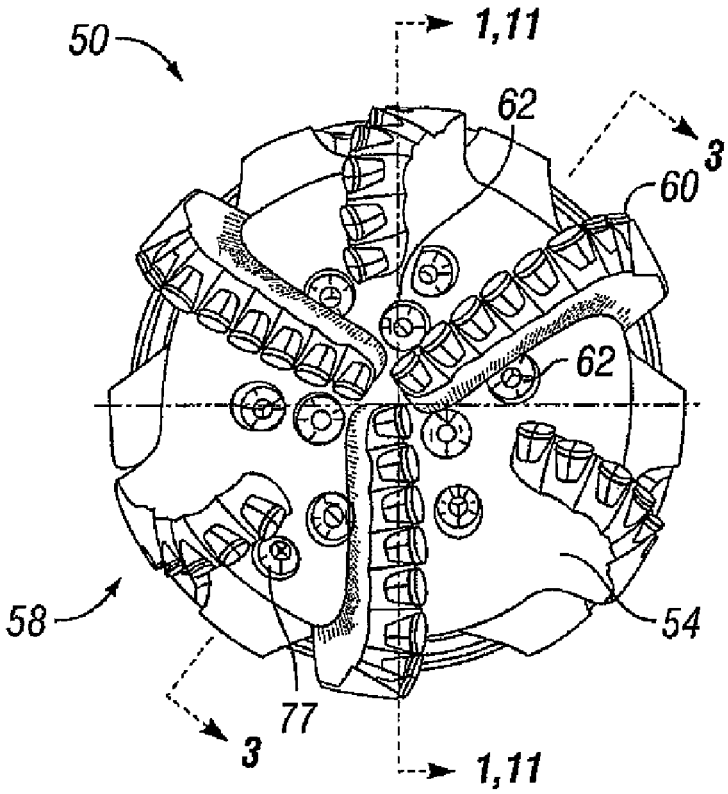
FIG. 2 is an end view drawing of the drilling assembly of FIG. 1.
Figure 3:
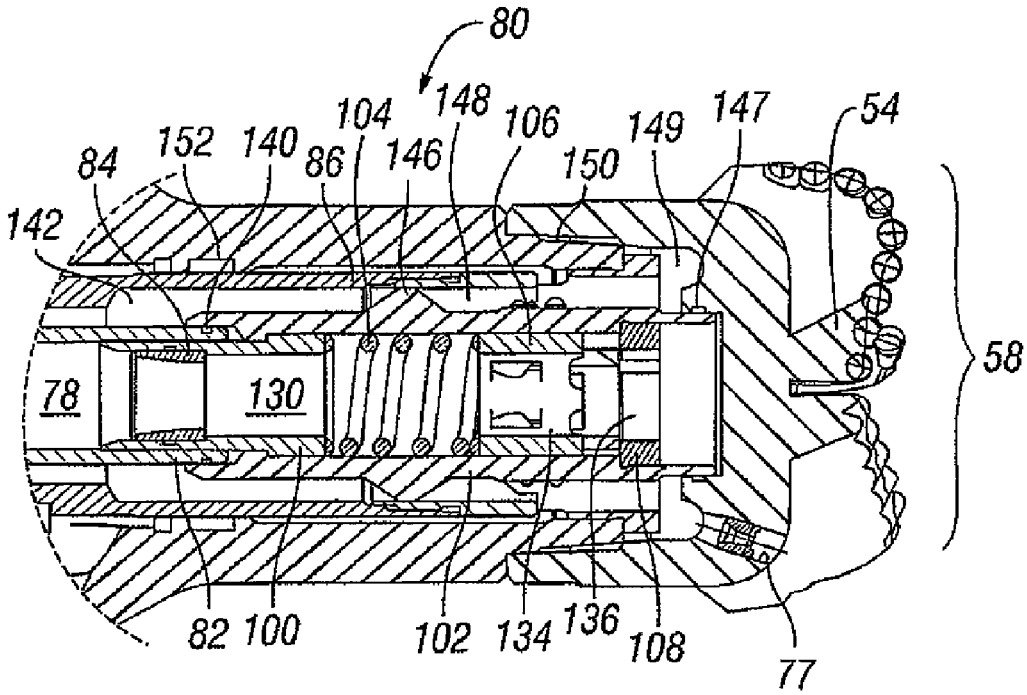
FIG. 3 is an alternative sectioned view of a portion of the drilling assembly of FIG. 1.
Figure 4:
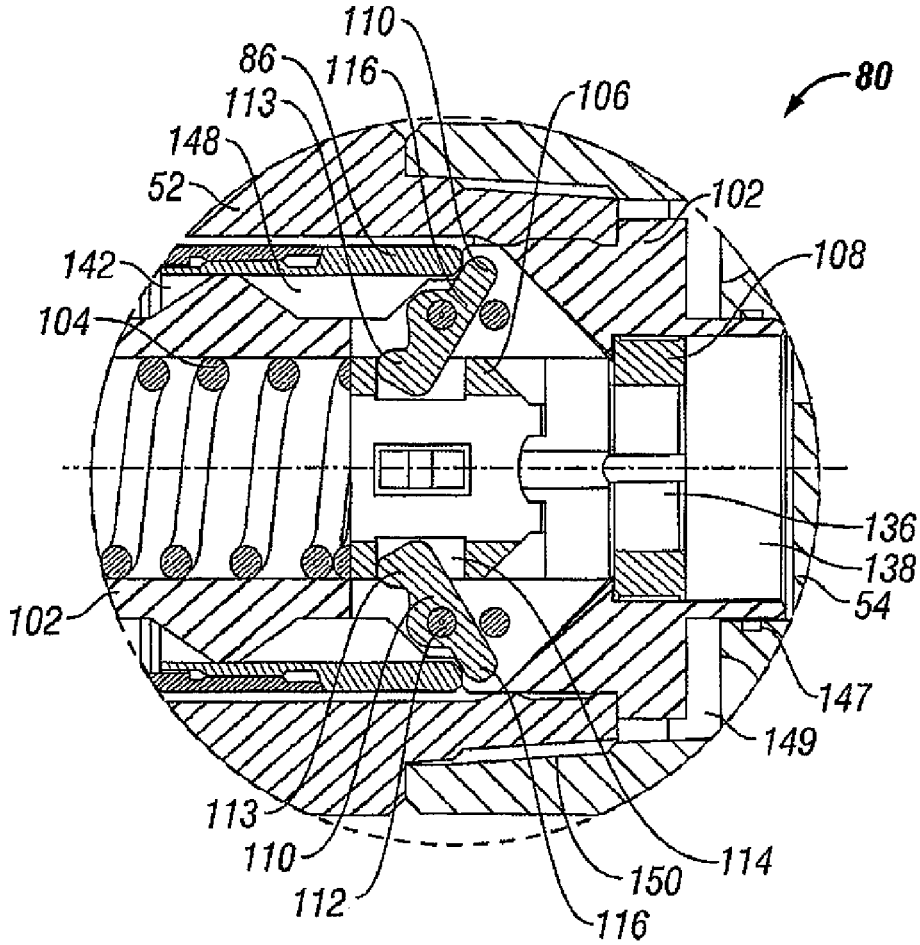
FIG. 4 is a close-up detail view of a lower portion of a flow switch of the drilling assembly of FIG. 1.
Figure 5:
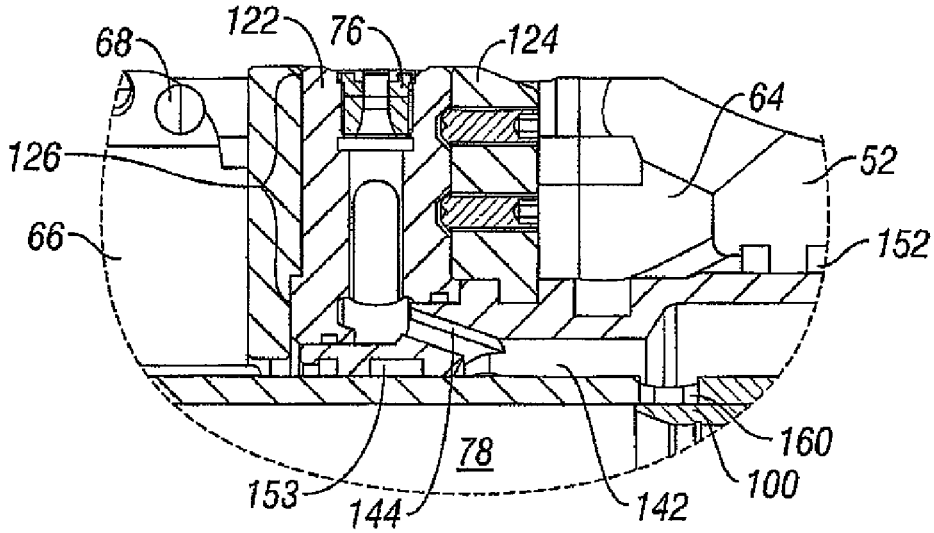
FIG. 5 is a close-up detail view of an extension assembly of the drilling assembly of FIG. 1.
Figure 6:
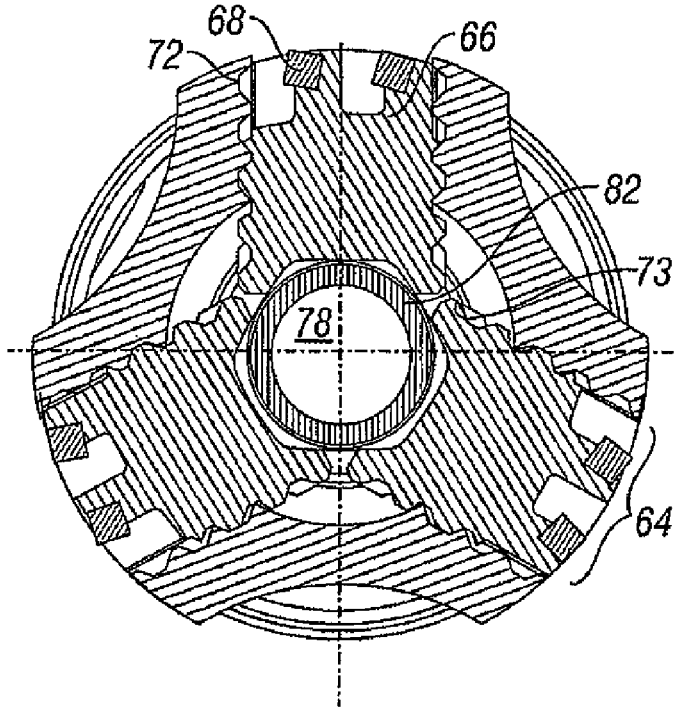
FIG. 6 is a cross-sectional view of the drilling assembly of FIG. 1 taken at 6-6.
Figure 7:
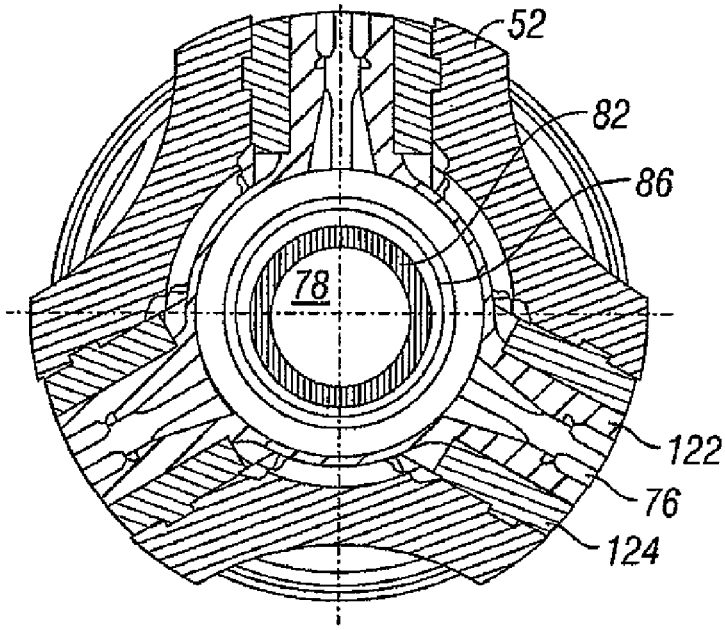
FIG. 7 is a cross-sectional view of the drilling assembly of FIG. 1 taken at 7-7.
Figure 8:
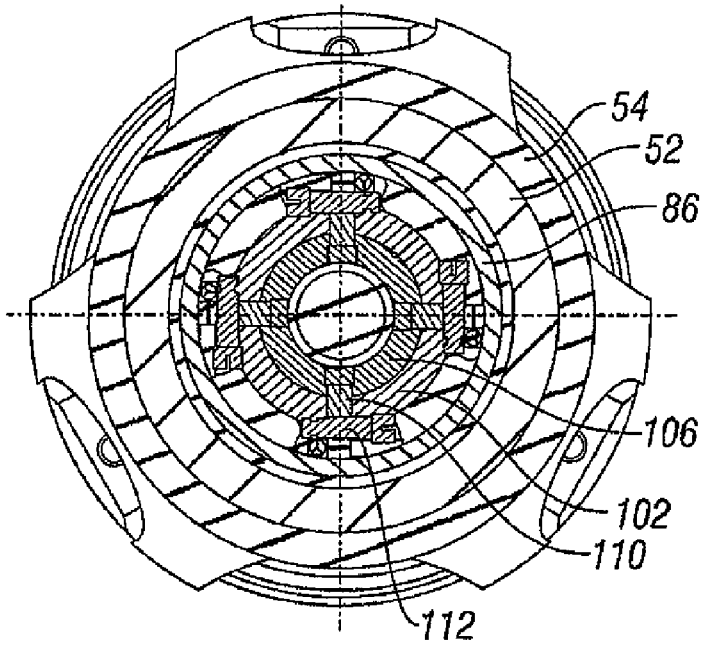
FIG. 8 is a cross-sectional view of the drilling assembly of FIG. 1 taken at 8-8.
Figure 9:
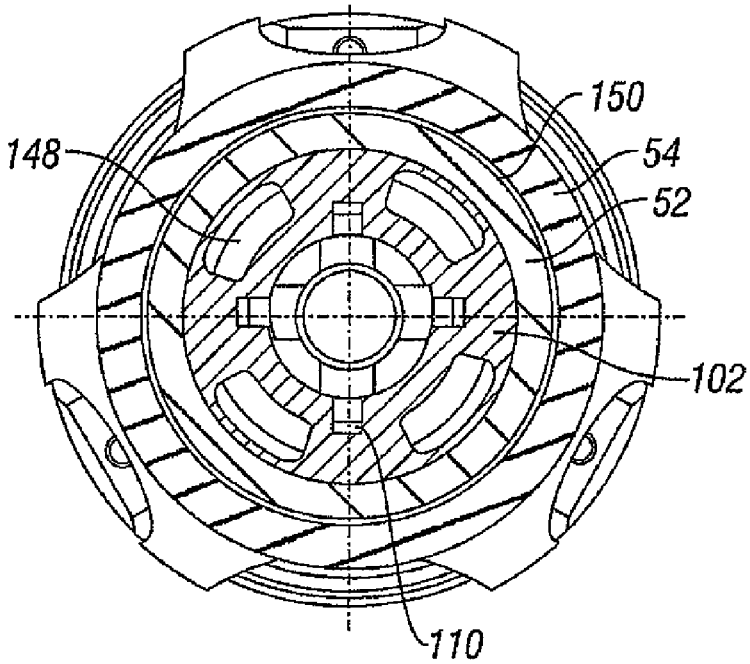
FIG. 9 is a cross-sectional view of the drilling assembly of FIG. 1 taken at 9-9.
Figure 10:
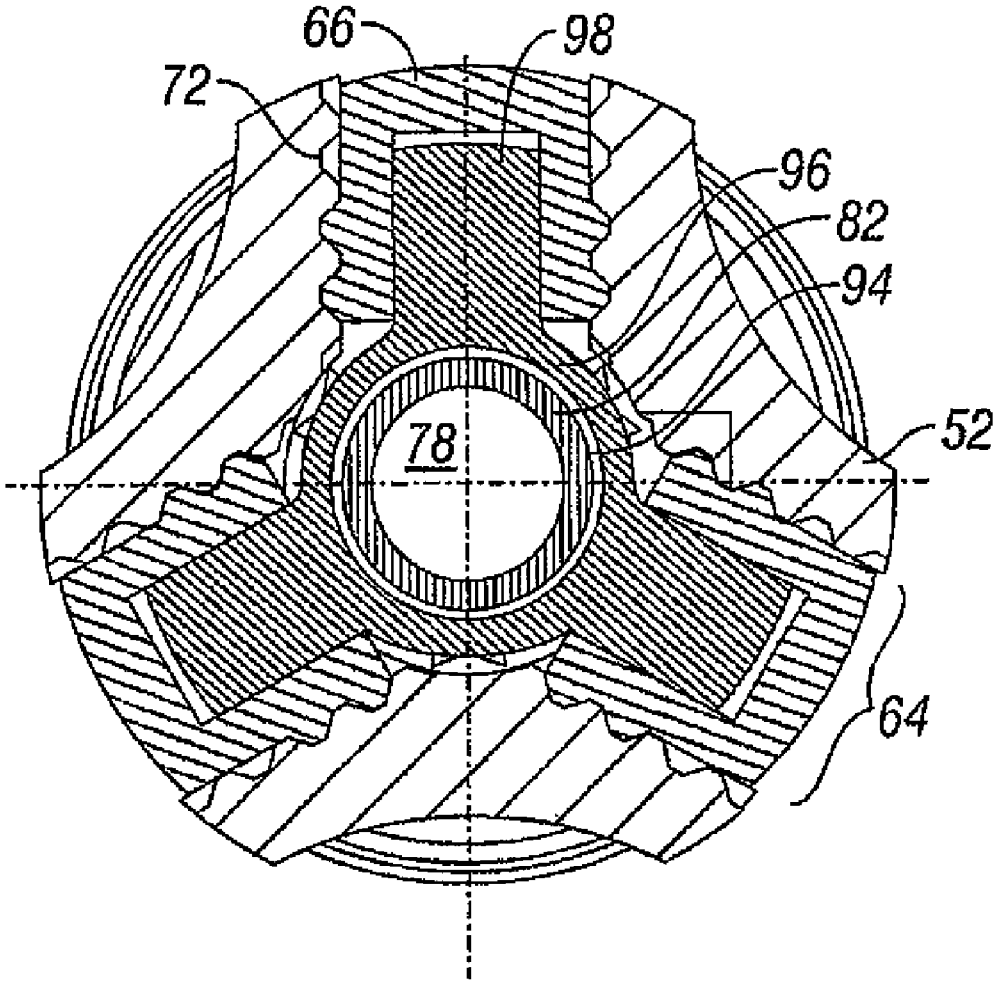
FIG. 10 is a cross-sectional view of the drilling assembly of FIG. 1 taken at 10-10.

Referring generally to FIGS. 1-10, an embodiment of drilling assembly 50 will be described in further detail. In FIG. 1A, a close up view of the distal end of drilling assembly 50 detailing a flow switch 80 is shown. FIG. 2 is an end view drawing of the distal end of drilling assembly 50 indicating the sectional view of FIGS. 1 and 1A at line 1-1. Similarly, FIG. 3 is an alternative sectional view of the distal end of drilling assembly 50 taken along line 3-3 of FIG. 2. FIG. 4 is an enlarged view of a portion of flow switch 80 of drilling assembly indicated by item 4 on FIGS. 1 and 1A. FIG. 5 is an enlarged view of a portion of drilling assembly indicated by item S on FIGS. 1 and 1A. FIG. 6 is a sectional view of drilling assembly 50 taken at line 6-6 in FIGS. 1 and 1A. FIG. 7 is a sectional view of drilling assembly 50 taken at line 7-7 in FIGS. 1 and 1A. FIG. 8 is a sectional view of drilling assembly 50 taken at line 8-8 in FIGS. 1 and 1A. FIG. 9 is a sectional view of drilling assembly 50 taken at line 9-9 in FIGS. 1 and 1A. FIG. 10 is a sectional view of drilling assembly 50 taken at line 10-10 in FIGS. 1 and 1A.

Referring now to FIGS. 1, 1A, 3, 4, 6, and 8-10 together, flow switch 80 includes a flow mandrel 82, a nozzle 84, and a piston 86. Mandrel 82 is housed within through bore 74 of main body 52, includes a central bore 78, and is anchored in place at its proximal end by a lock nut 88 in combination with a spring retainer 90. A spring 92 surrounds mandrel 82 and extends from spring retainer 90 to a spring sleeve 94. Spring sleeve 94 is connected at its distal end to a spring drive ring 96 positioned circumferentially around mandrel 82. Spring drive ring 96 includes a plurality of radial yoke-like extensions 98 engaged within arm assemblies 66. As such, when arm assemblies 66 are translated along grooves 72 in wall of axial recesses 64, radial extensions 98 and spring drive ring 96 thrust spring sleeve 94 upstream toward spring retainer 90, compressing spring 92 in the process. Yoke-like construction enables spring drive ring 96 to be located underneath and within arm assemblies 66, thereby conserving axial length of drilling assembly 50. When arm assemblies 66 are fully extended, an arm stop ring 99 prevents over-extension. Therefore, when a force thrusting arm assemblies 66 into engagement is removed, compressed spring 92 in conjunction with spring sleeve 94, drive ring 96 and radial extensions 98 return arm assemblies 66 to their retracted (shown), equilibrium state.

Referring specifically to FIGS. 1A, 3, 4, 8, and 9, flow switch 80 includes a flow tube 100 slidably engaged within the distal end of mandrel 82 and a proximal end of a piston stop 102. Flow tube 100 includes nozzle 84 at its proximal end and abuts a spring 104 at its distal end. Spring 104 extends within piston stop 102 from flow tube 100 to a spring retainer 106 that is slidably engaged within piston stop 102 between a steady state position (shown) and a stop ring 108. Toggles 110 pivotally secured to piston stop 102, rotate about hinge pins 112. Toggles 110 prevent spring retainer 106 from sliding within piston stop 102 until piston 86 moves from its retracted (shown) state to its extended state as a result of increases in hydraulic fluid pressure thereagainst. To accomplish this, inward ends 113 of toggles 110 are positioned within apertures 114 of spring retainer 106 and outward ends 116 of toggles engage the end of piston 86 as shown in FIG. 4. With piston 86 fully retracted, toggles 110 are unable to pivot about pins 112, such that apertures 114 of spring retainer 106 are unable to displace inward ends 113 of toggles 110. As a result of these restrictions, spring retainer 106 is unable to be displaced within piston stop 102 in the direction of stop ring 108, thereby maintaining the compressive load in spring 104.

Referring now to FIGS. 1, 1A, 3, 5, 7, and 13, an embodiment of extension assembly 120 will be described. Extension assembly 120 includes an arm drive ring 122, a plurality of arm drive sleeves 124, and a plurality of nozzles 76. When piston 86 is thrust upstream, the motion and force applied to piston 86 is, in turn, transferred to arm drive ring 122. Arm drive ring 122 is circumferentially disposed around piston 86 which is circumferentially disposed around mandrel 82 and within main body 52. As piston 86 thrusts arm drive ring 122 upstream towards drillstring connection 56, arm drive sleeves 124 surrounding radial extensions 126 of drive ring 122 engage distal ends of arm assemblies 66. As arm assemblies 66 are engaged by drive sleeves 124, they are thrust upstream and radially extended along grooves 72 of axial recesses 64. Furthermore, as piston 86 and arm drive ring 122 thrust arm assemblies 66 upstream, radial extensions 98 of spring drive ring 96 compress spring 92 surrounding mandrel 82. Once the thrusting force is removed from piston 86 and arm assemblies 66, spring drive ring 96 will act under the compressed load of spring 92 and retract arm assemblies 66.

Referring now to FIGS. 1, 1A, and 3-5, the operation of drilling assembly 50 will now be described. While in the retracted position (shown), drilling fluids flow through drilling assembly 50 from the drillstring through bore 74 and bore 78 of mandrel 82. A seal 128 located between spring retainer 90 and main body 52 prevents fluids from bypassing bore 78 of mandrel 82 and escaping through axial recesses 64. After flowing through bore 78, drilling fluids encounter nozzle 84 where they are accelerated and continue flowing through respective bores 130, 132, 134, and 136 of flow tube 100, piston stop 102, spring retainer 106, and stop ring 108. After exiting bore 136 of stop ring 108, the drilling fluids flow to a plenum 138 within cutting head 54, where they communicate with and flow through nozzles 62 adjacent to cutting structure 58.

Because of various sealing mechanisms, drilling fluid is not able to bypass fluid plenum 138 and nozzles 62 when drilling assembly 50 is in its retracted position. Particularly, a seal in groove 140 between mandrel 82 and piston stop 102 prevents fluid from escaping into a chamber 142 prematurely. As chamber 142 is in communication with the annulus through nozzles 76, arm drive ring 122, and a plurality of ports 144, seal in groove 140 prevents loss of drilling fluid pressure when drilling assembly 50 is retracted. Next, upset portion 146 of piston stop 102 forms a seal with inner diameter of piston 86 so that a chamber 148 formed between piston 86 and piston stop 102 cannot communicate with chamber 142. Additionally, a hydraulic seal in groove 147 isolates plenum 138 inside cutting head 54 from a chamber 149 in communication with chamber 148. Furthermore, seal grooves 152 and 153 containing wipers and seals (not shown), prevent drilling fluid from escaping between piston 86 and main body 52.

Finally, cutting head 54 is shown attached to main body 52 by means of an oilfield rotary threaded connection 150 approximately between chambers 148 and 149. Because such rotary connections are generally fluid-tight, substantially no drilling fluids escape drilling assembly 50 other than through nozzles 62 when in the retracted state. While a detachable rotary threaded connection 150 is shown, it should be understood that an integrally formed (e.g. welded, machined, etc.) cutting head 54 may also be employed. However, rotary threaded cutting head 54 has the advantage of being removable should cutting head 54 require replacement. Furthermore, because a reduced-height connection is used between cutting head 54 and the rest of drilling assembly 50, cutting head 54 is substantially unitary with expandable cutters 68 and stabilizers 70 such that an axial length therebetween is minimized. A reduced axial length (e.g. between 1-5 times the cutting diameter of cutting head 54) between the trailing edge of cutting head 54 and the leading edge of retracted arm assemblies 66 may be useful in reducing side loads experienced by cutters 68 during operation. Having cutting structures of cutter body 54 proximate and disposed upon the same tool as expandable cutters 68 allows cutting geometry 58 of cutting head 54 to be optimized (if desired) to correspond with the arrangement of cutter elements 68 on arm assemblies 66 to maximize cutting efficiency and durability while reducing vibrations within drilling assembly 50.

Referring now to FIGS. 11, 12, 15, and 16, drilling assembly 50 is shown in its fully extended state. When the drilling operator desires to extend arm assemblies 66, the pressure of drilling fluids flowing through the drillstring is increased to a point above a preselected activation value. The geometry of nozzle 84 within flow tube 100 and the spring constant of spring 104 within piston stop 102 are desirably selected to allow for displacement of flow tube 100 within piston stop 102 at the selected activation value. Once reached, fluid flowing across nozzle 84 at the activation pressure creates a resultant force large enough to displace flow tube 100 within mandrel 82 and piston stop 102 against spring 104. Concealed apertures 160 within distal end of mandrel 82, in communication with chamber 142 become exposed as flow tube 100 is displaced downstream. With apertures 160 exposed, drilling fluids within bore 78 of mandrel 82 communicate with nozzle 76 through ports 144 and chamber 142. At this point, the characteristic pressure drop of drilling assembly 50 changes to an intermediate profile, detectable at the surface by an operator. Once the intermediate profile is observed, the operator knows the activation of drilling assembly 50 has begun as with apertures 160 exposed, fluid is able to escape from bore 78 to the annulus through nozzles 76.

To fully extend arm assemblies 66 of drilling assembly 50, the pressure of drilling fluids may be maintained or increased so that the pressure across piston 86 between seals 152 and 153 is enough to create enough resultant force in piston to overcome the force of spring 92. As piston 86 is thrust upstream by fluid pressure in chamber 142 acting across seals 152 and 153, the distal end of piston 86 pulls away from outward ends 116 of toggles 110. With piston 86 no longer restraining outward ends 113, toggles 110 pivot around pins 112 thereby allowing spring retainer 106 to be displaced within piston stop 102 until it contacts stop ring 108. With spring retainer 106 displaced into stop ring 108, the compressive load within spring 104 is reduced, thereby preventing flow tube 100 from oscillating back and forth within piston stop 102. Nonetheless, as arm assemblies 66 are thrust upstream by piston 86 in conjunction with drive ring 122, grooves 72 within wall of axial recesses 64 cooperate with corresponding grooves 73 to radially expand arm assemblies 66 until stop ring 99 is encountered as shown in FIG. 11.

Figure 11:
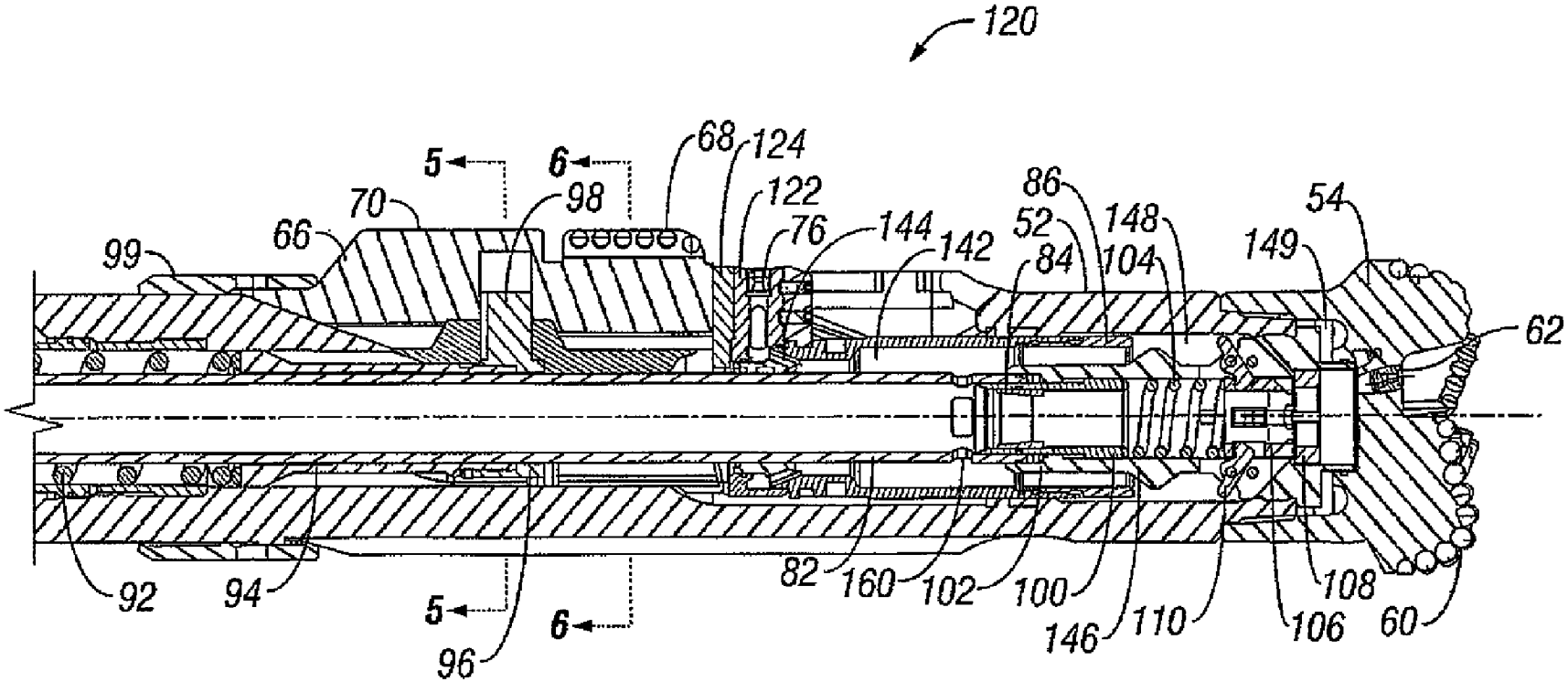
FIG. 11 is a sectioned view drawing of the drilling assembly of FIG. 1 in a fully extended position.
Figure 12:
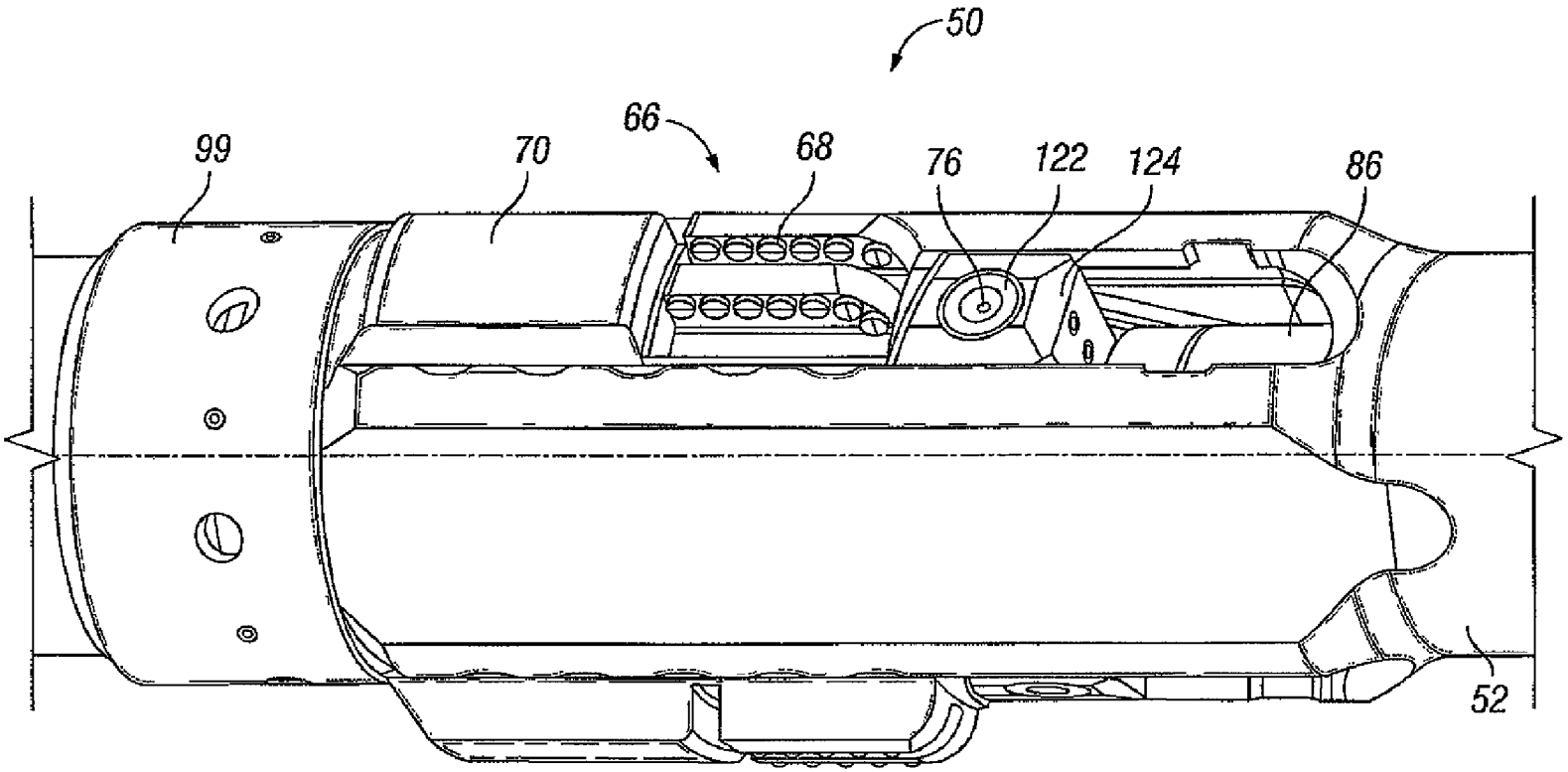
FIG. 12 is an isometric view of the drilling assembly of FIG. 1 in the fully extended position.
Figure 13:
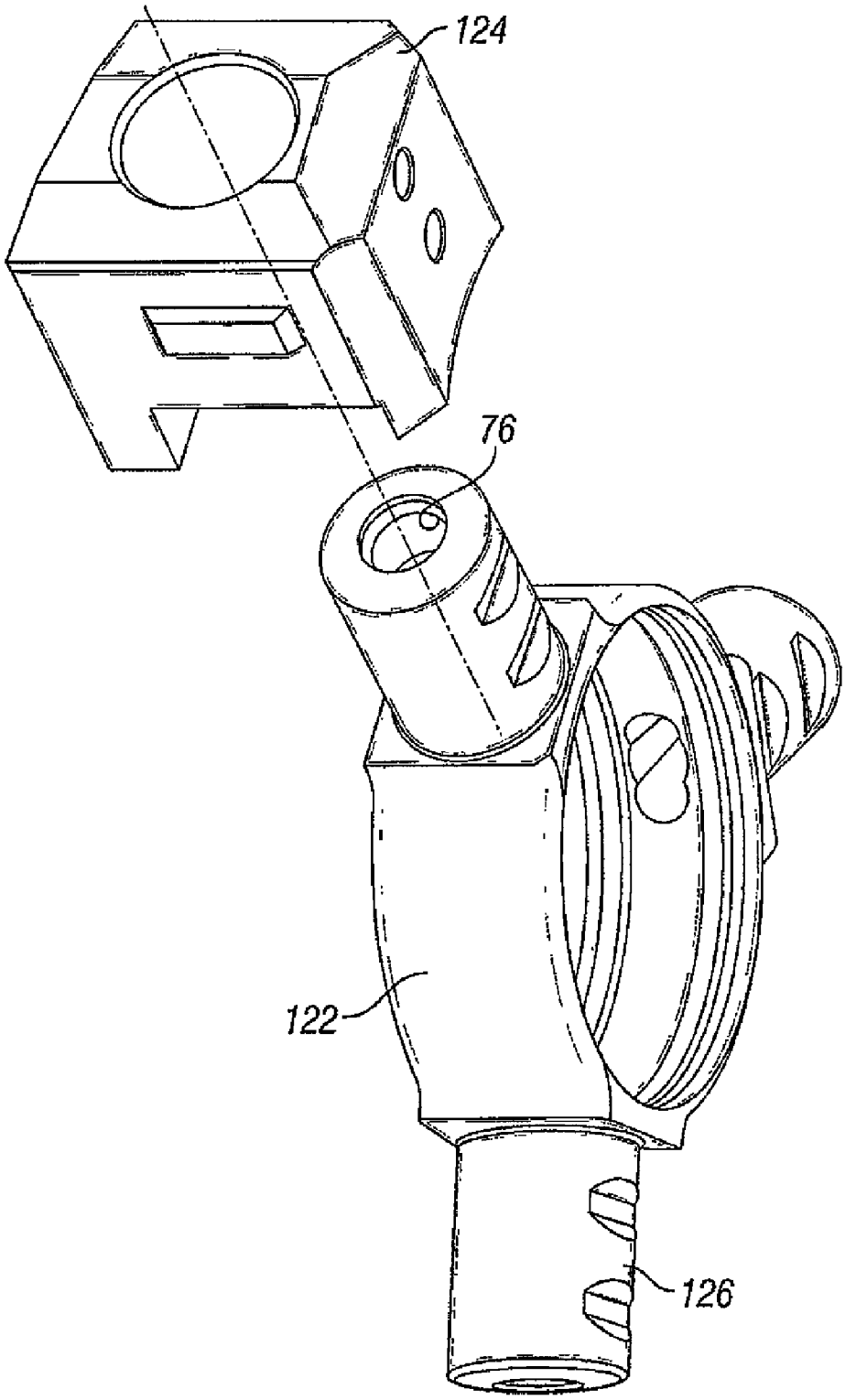
FIG. 13 is an exploded isometric view of the extension assembly of FIGS. 1 and 11.

Referring specifically to FIG. 11, the drilling assembly 50 is shown in the fully expanded state. As can be seen in FIG. 11, with arms filly extended, the distal end of piston 86 is completely clear of portion 146 of piston stop 102. In this position, chambers 142, 148, and 149 are all in fluid communication with each other such that pressurized drilling fluids from bore 78 can communicate with them through apertures 160. Therefore, with arm assemblies 66 fully extended, an indication nozzle 77 (visible in FIG. 3) in communication with chamber 149 is activated such that drilling fluids flowing through bore 78 may escape therethrough. Therefore, when fully activated, drilling assembly 50 will exhibit yet another characteristic pressure drop, one associated with the fully-expanded state. An operator at the surface will be able to observe the change in the pressure drop profile and will know that the drilling assembly 50 is ready to be operated in the extended state.

Of particular note, with spring retainer 106 thrust into stop ring 108, the amount of pressure required to maintain flow switch 80 in the fully open position is reduced as the amount of force required to overcome spring 104 is reduced. Therefore, when fully extended, the amount of pressure required to keep flow tube 100 compressed against spring 104 in order to expose apertures 160 is likewise reduced but, as a general rule, the higher pressures are typically maintained. As such, the pressure of drilling fluids necessary to keep arm assemblies 66 extended only needs to be sufficient to overcome the force of compressed spring 92.

When retraction of arm assemblies 66 is desired, the pressure of drilling fluids is reduced to a reset level (or cut-off completely) so that spring 92 retracts arm assemblies 66 through spring drive ring 96. The retraction of arm assemblies 66 thrusts piston 86 downstream such that it re-engages upset portion 146 of piston stop 102 and outward ends 116 of toggles 110. As such, spring retainer 106 is driven back to it's original position and spring 104 likewise re-energized to thrust flow tube 100 upstream to cover apertures 160.

With arm assemblies 66 retracted, flow is again cut off to nozzles 76 and 77. Once retracted, the operator monitoring the pressure drop at the surface will be aware of the complete retraction of drilling assembly 50 when it exhibits the characteristic pressure drop associated with the retracted profile once again. If any debris or other matter is clogged within axial recesses 64, preventing the complete retraction of arm assemblies 66, the surface operator will be notified when the retracted pressure drop profile is not observed. In such a case the surface operator may attempt to cycle the drilling assembly 50 in an attempt to clear the obstruction. Once reset, the drilling assembly may be re-extended in the same manner as described above.

Figure 17:
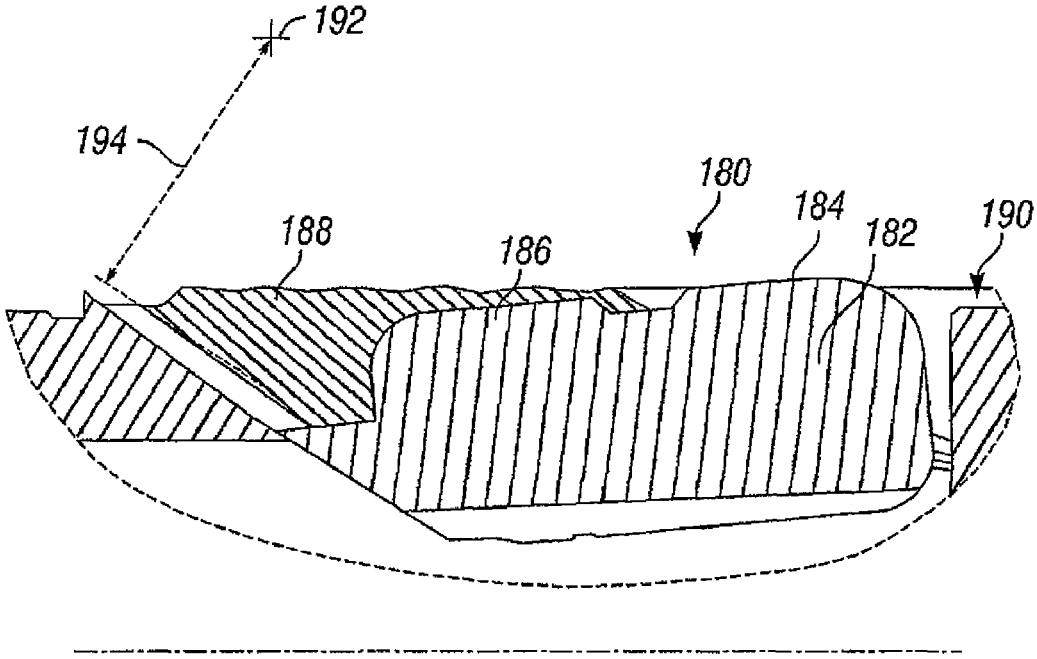
FIG. 17 is a cross-sectional view of a first alternative arm assembly extension mechanism in a retracted position in accordance with an embodiment of the present disclosure.
Figure 18:
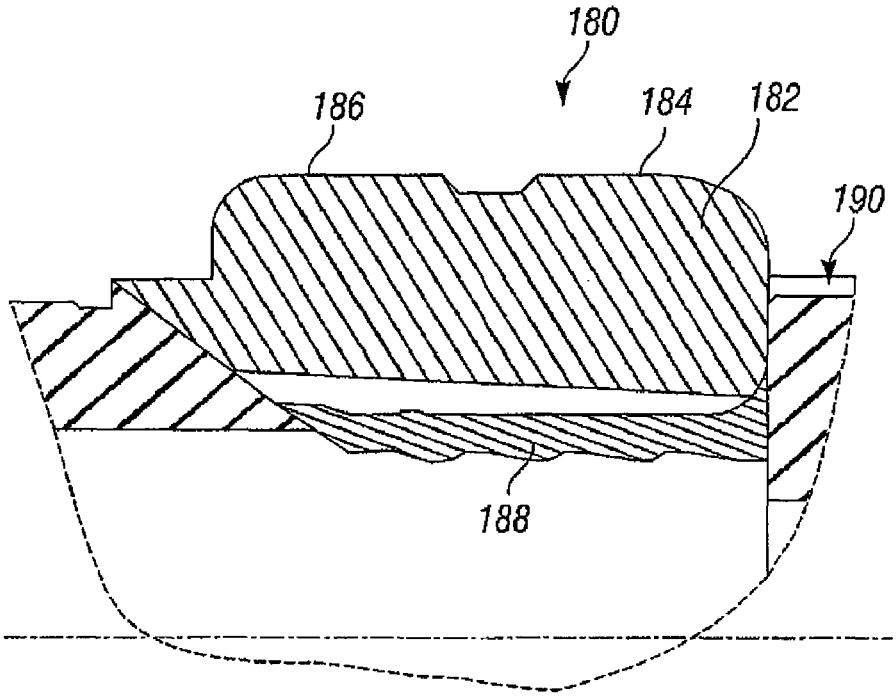
FIG. 18 is a cross-sectional view of the extension mechanism of FIG. 18 in an extended position.

Referring now to FIGS. 17 and 18, an alternative arrangement for an arm assembly 180 is shown. Alternative arm assembly 180 includes an arm 182 having a cutting portion 184 and a stabilizer portion 186. As such, arm 182 translates from a retracted (FIG. 17) position to an extended (FIG. 18) position along a plurality of grooves 188 within a wall of an axial recess 190 of a drilling assembly. In some circumstances, it is desirable for the cutting portion 184 of an arm assembly 180 to engage the borehole before stabilizer portion 186. Particularly, it has been observed that there is some difficulty in beginning a cut when stabilizer portion 186 and cutting portion 184 engage the formation simultaneously. Therefore, arm assembly 180 advantageously allows cutting portion 184 to engage the formation first by employing a radial configuration for grooves 188. Particularly, grooves 188 are constructed as concentric sections of circles having a common center 192 and a maximum radius 194. As such, when retracted within recess 190, arm 182 is positioned such that cutting portion 184 is extended slightly more outward than stabilizer portion 186. However, once extended, both cutting portion 184 and stabilizer portion 186 of arm 182 are at the same radial height.

Figure 19:
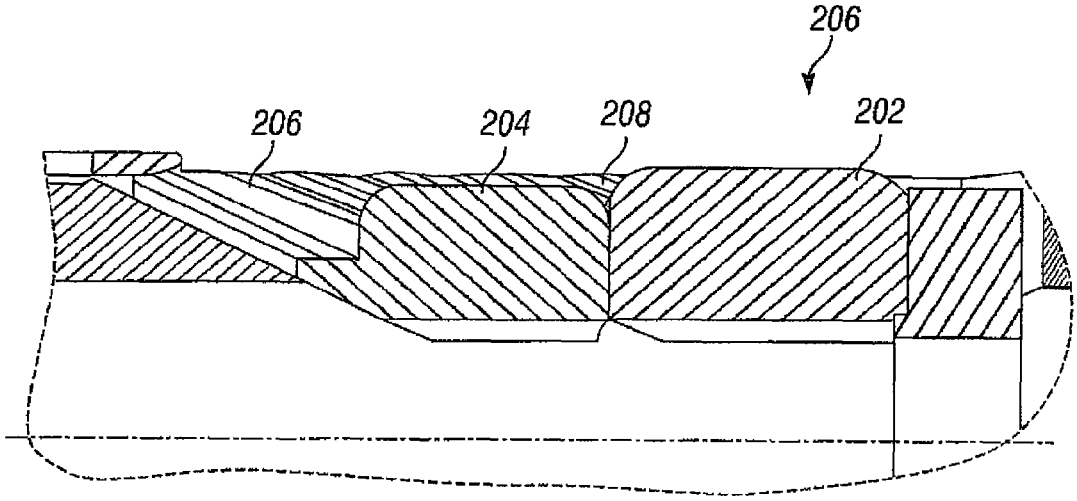
FIG. 19 is a cross-sectional view of a second alternative arm assembly extension mechanism in a retracted position in accordance with an embodiment of the present disclosure.
Figure 20:
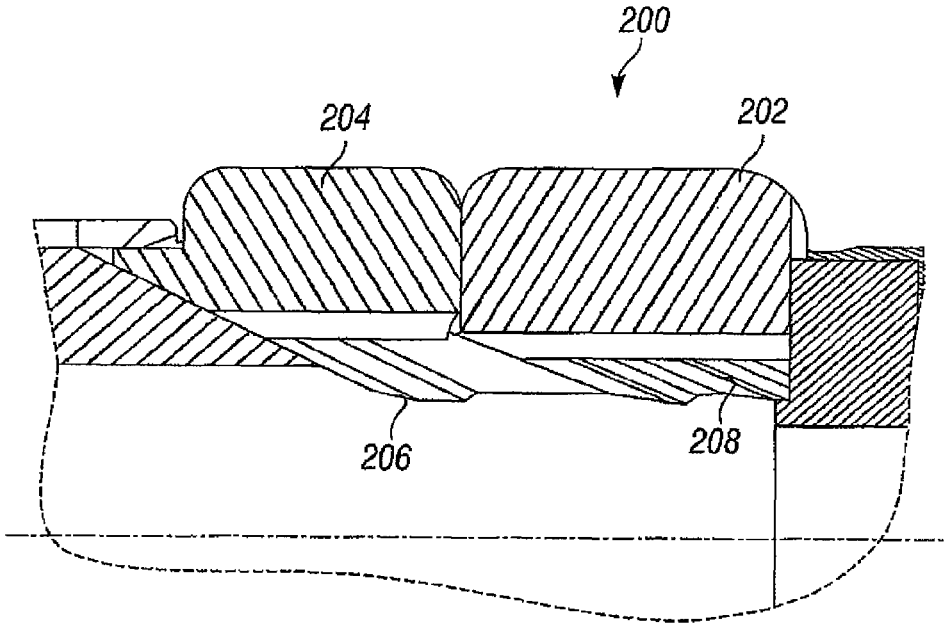
FIG. 20 is a cross-sectional view of the extension mechanism of FIG. 19 in an extended position.

Referring now to FIGS. 19 and 20, a second alternative arrangement for an arm assembly 200 is shown. Alternative arm assembly 200 includes two separate arms, a cutter arm 202 and a stabilizer arm 204, each extendable radially along its own set of linear grooves 206, and 208. As may be appreciated, the extension of cutter arm 202 ahead of stabilizer arm 204 is accomplished by having a steeper slope for stabilizer arm extension grooves 206 than cutter arm grooves 208. In addition, stabilizer arm 204 is installed in the arm pocket such that it is initially inboard of cutter arm 202. However, once extended, both cutter arm 202 and stabilizer arm 204 are at the same radial height. Therefore, cutter arm 202 will engage the formation before stabilizer arm 204.

Figure 21:
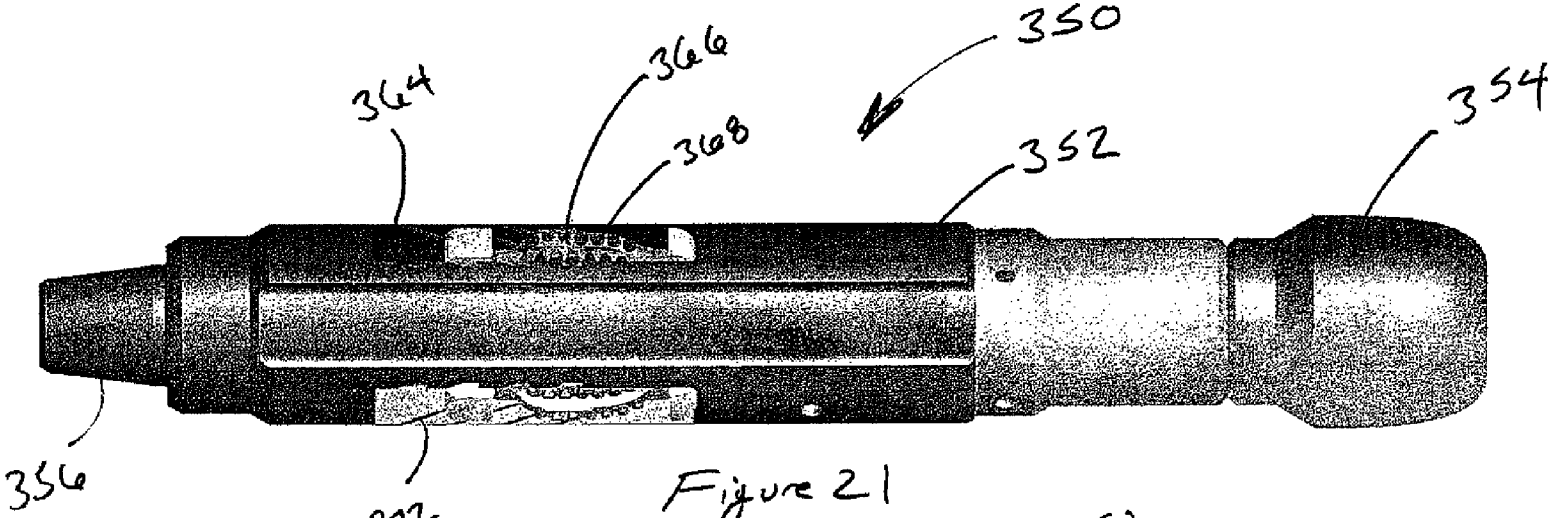
FIG. 21 is a profile view of a drilling assembly in an accordance with an alternative embodiment of the present disclosure in a retracted position.
Figure 22:
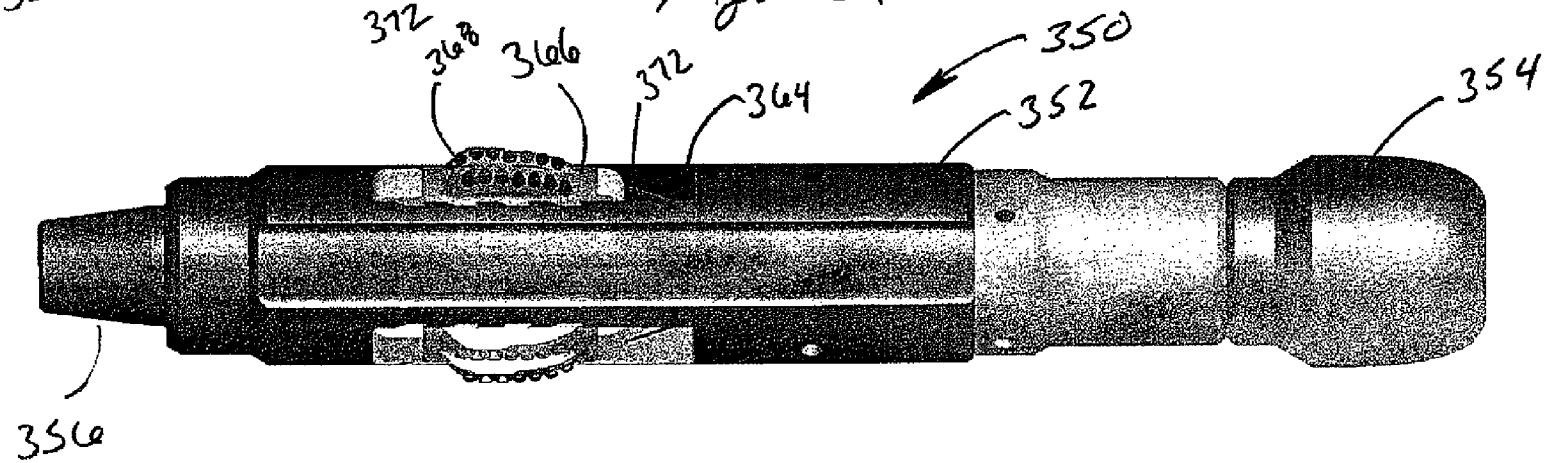
FIG. 22 is a profile view of the drilling assembly of FIG. 21 in an extended position.

Referring now to FIGS. 21 and 22 together, an alternative drilling assembly 350 is shown. Drilling assembly 350 is depicted in FIG. 21 in a retracted (collapsed) state and is depicted in FIG. 22 in an extended state. As such, drilling assembly 350 includes a main body 352, a cutting head (i.e., a drill bit) 354, and a drillstring connection 356. While a PDC bit is disclosed for cutting head 354, it should be understood that any type or configuration of cutting head or drill bit may be used including, but not limited to, roller cone bits and disc-type bits. As described above, while drillstring connection 356 is depicted as a rotary threaded connection, one of ordinary skill in the art will appreciate that any method of connection between drilling assembly 350 and the remainder of the drillstring (not shown) may be used. For the purposes of this disclosure, drillstring 356 will be considered as the "top" of drilling assembly 350.

Furthermore, drilling assembly 350 includes a plurality of axial recesses 364 into which arm assemblies 366 are positioned. As described above, arm assemblies 366 are configured to extend from a retracted (FIG. 21) position to an extended position (FIG. 22) when cutting elements 368 are to be engaged with the formation. Further, while arm assemblies 366 are depicted as having only cutting structure, it should be understood that stabilizers may be positioned upon arm assemblies 366 as well. As described above in reference to drilling assembly 50, arm assemblies 366 travel from their retracted position to their extended position along a plurality of grooves 372 within the wall of axial recesses 364. Corresponding grooves (not visible) along the outer profile of arm assemblies 366 engage grooves 372 and guide arm assemblies 366 as they traverse in and out of axial recesses 364.

Figure 23:
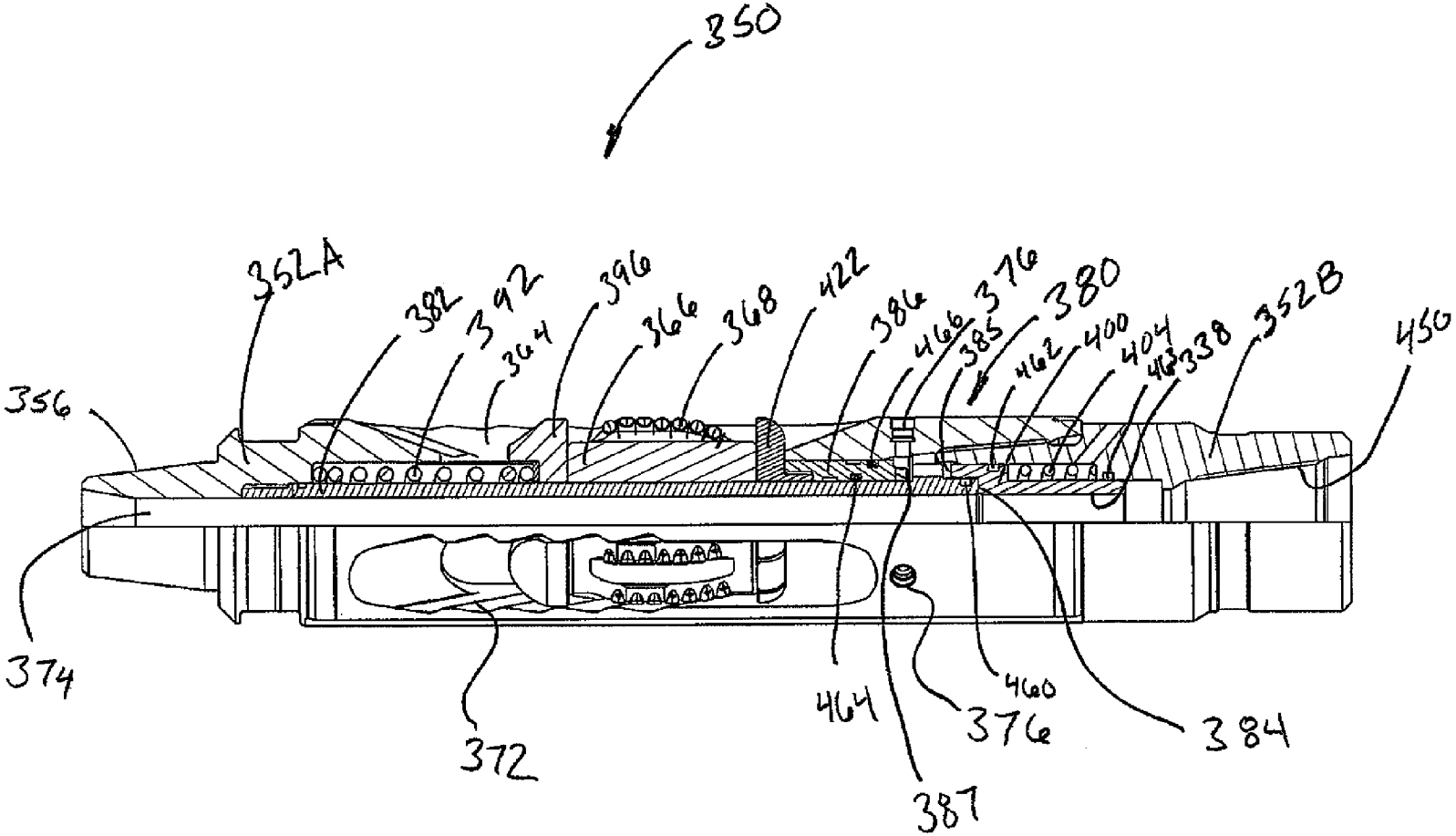
FIG. 23 is partial section-view drawings of the drilling assembly of FIG. 21.

Referring now to FIG. 23, drilling assembly 350 is shown in further detail. As shown, main body 352 is divided into two threadably connected sections, an upper section 352A and a lower section 352B to ease in the assembly, disassembly, and maintenance of components of drilling assembly 350. While shown divided, one of ordinary skill in the art would understand that a single one-piece member may be constructed for main body 352 without departing from the scope of the claimed subject matter.

Furthermore, drilling assembly 350 is actuated from the retracted position (shown) to the extended position by action of a drive piston 386. A flow switch 380 is configured to selectively allow pressure to be applied to drive piston 386. Drive piston 386 is configured to convert pressure from drilling mud in a bore 374 of drilling assembly 350 into force to extend arm assemblies 366 from axial recesses 364. Flow switch 380 further includes a flow mandrel 382 and a selector piston 400. Selector piston 400 is biased upstream by a selector spring 404. Drive piston 386 abuts a drive plate 422, arm assembly 366, and a return block 396. A biasing member 392 acts between a shoulder of main body section 352A and return block 396. Biasing member 392 and selector spring 404 are shown as coil springs, but may be any type of biasing member known to one of ordinary skill in the art including, but not limited to, Bellville washer springs, wave springs, and elastomeric springs.

As such, in the retracted position (shown), biasing member 392 urges return block 396 in a downward direction, thereby urging arm assemblies 366 downward. Grooves 372 of axial recesses 364 interact with corresponding grooves (not visible) of arm assembles 366 such that as they are downwardly displaced, arm assemblies 366 radially retract within axial recesses 364. Furthermore, as arm assemblies 366 are retracted, drive plate 422 and drive piston 386 are downwardly displaced. Furthermore, as shown in the retracted position, selector spring 404 thrusts selector piston 400 in an upward direction such that a sealing engagement is made between selector piston 400 and main body section 352B and between selector piston 400 and distal end of flow mandrel 382.

In the retracted position shown in FIG. 23, pressurized drilling fluids enter drilling assembly 350 through bore 374 at threaded connection 356 of main body section 352A, travel through flow mandrel 382, through a bore 338 of selector piston 400. Once fluids pass through selector piston bore 338, they flow through distal end of main body section 352B and to drill bit (not shown) below. In this configuration, drilling assembly 350 exhibits a characteristic pressure drop profile corresponding to the un-activated state. A seal 460 prevents fluid from escaping between flow mandrel 382 and selector piston 400. Similarly, seals 462 and 463 prevent fluids from escaping between selector piston 400 and an inner bore of main body section 352B, and seals 464 and 466 isolate drive piston 386 from flow mandrel 382 and main body section 352A, respectively. One of ordinary skill in the art would appreciate that alternative sealing arrangements, geometries, and systems may be used without departing from the claimed subject matter.

To extend arm assemblies 366, pressure in bore 374 is increased until an activation value is achieved. Once the activation pressure is reached, the force upon a pressure area 384 of selector piston 400 is sufficient to overcome selector spring 404. As pressure in bore 374 exceeds the activation value, selector piston 400 is thrust downward until seal 460 between selector piston 400 and flow mandrel 3 82 is exposed.

Furthermore, as selector piston 400 is downwardly displaced, disengaging seal 460, a secondary pressure area 385 of selector piston 400 is exposed to fluids from bore 374. As a result, the amount pressure in bore 374 required to maintain selector piston 400 in the open position will be less than the amount of fluid pressure required to open selector piston 400 from the closed (shown) position (i.e., the activation pressure). As should be appreciated by those of ordinary skill, the stiffness of selector spring 404 may be selected, the piston area modified, or both to allow opening of selector piston 400 at a desired fluid pressure.

With selector piston 400 in the open position, drilling fluids from bore 374 are able to communicate with nozzles 376 and act upon drive piston 386. With drilling fluids in communication with, and exiting through nozzles 376, drilling assembly 350 exhibits a characteristic pressure drop profile corresponding to the activated state. Upon noticing the change in pressure drop profile from retracted state to activated state, a drilling operator at the surface is able to determine that selector piston 400 has been activated and that arm assemblies 366 are capable of being extended.

Once activated, drilling fluids are able to act upon a pressure area 387 of drive piston 386. As drilling fluid pressure is increased, drive piston 386 displaces drive plate 422, arm assembly 366, and return block 396 against biasing member 392. As such, biasing member 392 may be sized to require a specified amount of force to be applied to arm assemblies 366 by drive piston 386 through grooves 372 before they will extend. Furthermore, the thickness of return block 396 may be sized to limit the maximum radial distance arm assemblies 366 may extend.

In one embodiment, pressure area 387 of drive piston 386 and biasing member 392 are constructed such that the fluid pressure required to extend arm assemblies 366 is lower than the fluid pressure required to open selector piston 400. Alternatively, drive piston 386 and biasing member 392 may be constructed such that the amount of fluid pressure required to extend arm assemblies 366 is higher than the fluid pressure required to open selector piston 400. Similarly, pressure areas 384 and 385 and selector spring 404 may be selectively constructed to modify the activation pressure of drilling assembly 350.

When retraction of arm assemblies 366 is desired, fluid pressure through bore 374 may be reduced such that biasing member 392 may thrust return block 396, arm assembly 366 and drive plate 422 against drive piston 386. If the retraction of arm assemblies 366 is to only be temporary (e.g., when passing through a restriction in the wellbore), the pressure may reduced enough to retract arm assemblies 366, but kept high enough to keep selector piston 400 in the open position. If the retraction is to be for a longer amount of time, the pressure may be dropped below a reset value, where selector piston 400 is returned to a closed position (shown).

Figure 24:
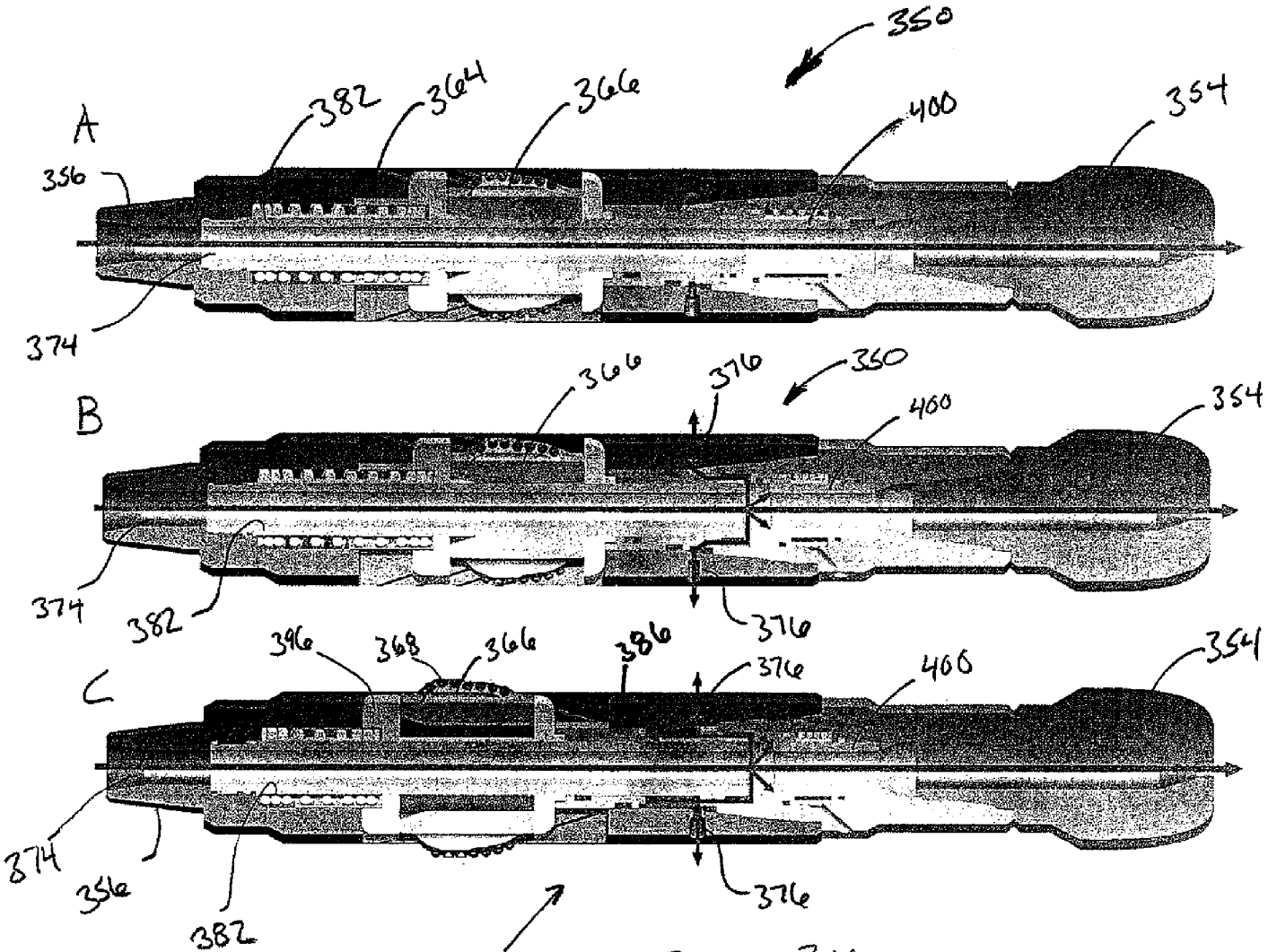
FIG. 24 is a section-view drawing of the drilling assembly of FIG. 21 detailing fluid flow.

Referring now to FIGS. 24A-C, the activation of drilling assembly 350 may be further observed. In FIG. 24A, drilling assembly 350 is shown in a retracted and un-activated state, where arm assemblies 366 are retracted within axial recesses 364 and selector piston 400 is in the closed position. In this configuration, pressurized fluids enter bore 374 at drillstring connection 356 and pass through flow mandrel 382, closed selector piston 400, and cutting head 354. In this configuration, drilling assembly 350 exhibits a characteristic pressure drop profile associated with an un-activated state. In this state, drilling assembly 350 may be used for drilling operations without extending arm assemblies 366 as long as the pressure in bore 374 is kept below the activation pressure.

Referring now to FIG. 24B, the pressure in bore 374 has reached the activation value such that selector piston 400 is now in the open position and fluids flow from flow mandrel 382, through nozzles 376 and through cutting head 354. In this configuration, drilling assembly 350 is in the activated state, but arm assemblies 366 are not extended. Furthermore, as nozzles 376 are now in communication with fluids in bore 374, drilling assembly 350 exhibits a characteristic pressure drop profile associated with an activated state. In the configuration shown in FIG. 24B, a drilling operator may either increase the pressure of fluids in bore 374 to extend arm assemblies 366, or may reduce the pressure below the reset value to close selector piston 400.

Referring now to FIG. 24C, the pressure to bore 374 is increased over the activation value to extend arm assemblies 366. As with FIG. 24B described above, high-pressure fluid enters bore 374 through drillstring connection 356, passes through flow mandrel 382, and flows out through nozzles 376 and cutting head 354 as it bypasses and flows through selector piston 400. Furthermore, the increased pressure acts upon drive piston 386 and extends arm assemblies 366.

With arm assemblies 366 extended, cutting elements 368 are able to engage and underream the formation. Alternatively, arm assemblies 366 may include stabilizer pads (not shown) in addition or in place of cutting elements 368, as required by the particular drilling operation. Alternatively still, a third characteristic pressure drop profile corresponding to the fully extended state of arm assemblies 366 may be included within the design of drilling assembly. Such a design would include additional nozzles in communication with bore 374 upon full extension of arm assemblies 366.

When retraction is desired, pressure in bore 374 is reduced and biasing member 392 retracts arm assemblies 366 though return block 396. With arm assemblies 366 retracted, selector piston 400 may remain in the open position (with drilling assembly 350 exhibiting the activated pressure drop) until pressure in bore 374 falls below a reset value. Once drilling assembly 350 is reset with selector piston 400 in the closed position, the un-activated pressure drop is observed and drilling assembly 350 may remain in the borehole without concern for re-activation unless pressure in bore 374 exceeds the activation value again.

In one exemplary embodiment, drilling assembly 350 may expand from 5-⅝" to 7" with arm assemblies 366 extended. Thus, cutting head 354 may be, at a minimum, a 6" gauge drill bit. As such, drilling assembly 350 may be constructed such that cutting elements 368 of arm assemblies 366 are within 30 inches (ie., within 5 times the diameter) of cutting head 354. Furthermore, drilling assembly 350 may be constructed to activate in response to an increase in pressure of 350 psi and fully open in response to an additional increase of 115 psi. However, it should be understood by one of ordinary skill in the art that other gauge sizes and pressure differentials may be used without departing from the scope of the claims appended hereto.

Embodiments disclosed herein may have various advantages over the prior art. Particularly, the drilling assemblies disclosed herein include bits, an underreamers, and/or stabilizers within close axial proximity to one another. Advantageously, having an adjustable stabilizer proximate (e.g. axially spaced within 1-5 times the diameter of the pilot bit) to an underreamer may prevent the underreamer from taking heavy side loads and assuming the role of a fulcrum in a directionally drilled wellbore. Having an adjustable stabilizer adjacent to the cutting structure of an underreamer may prevent premature wear and damage to the cutting structure as a result of such side loading. Furthermore, having the pilot bit assembly proximate to an underreamer may further minimize the fulcrum effect, thereby maximizing the life of the cutting structures of both the pilot bit and the underreamer. By making the pilot bit integral with the underreamer mechanism, the axial length therebetween may be minimized.

Furthermore, the optional flex member located upstream of the stabilizer/underreamer mechanism may enable larger build rates in certain directional drilling applications. The use of such an flex member is described by U.S. patent application Ser. No. 11/334,707 entitled "Flexible Directional Drilling Apparatus and Method" filed on Jan. 18, 2006 by inventors Lance Underwood and Charles Dewey, hereby incorporated by reference in its entirety.

Depending on the geometry and type of equipment upstream of a flex member, the combination of the pilot bit, underreamer, and/or stabilizer may be treated together as a fulcrum in a directional drilling system, rather than each component as a single node in a flexible string. As such, additional expandable stabilizers, including those of the type described in U.S. Pat. No. 6,732,817, may be located upstream of the drilling assembly to implicate a desired build angle in the trajectory of the drilling assembly.

Furthermore, the drilling assemblies disclosed herein have the aforementioned benefit of distinct changes in the pressure drop profile to indicate the status of tool activation and/or the arm assemblies. Particularly, using the drilling assembly disclosed herein, a driller will be able to know, with some degree of accuracy, when the arms may be retracted, when they are fully extended, and when they are in transition from retracted to extended. As such, the operator will no longer have to guess or estimate what state the underreamer or stabilizer is in.

Finally, as mentioned above, the drilling assembly disclosed herein employs actuation mechanisms that not only indicate the status of actuation, but are also capable of being completely reset to their pre-activation states. Particularly, as outlined above, former actuation mechanisms could not be deactivated once activated, thereby reducing the flexibility of the bottom hole apparatus following activation. In contrast, using the actuation mechanisms disclosed herein, downhole tools may return to their original state when their activated state is no longer needed. Therefore, if, after drilling an underreamed hole for a particular distance, a non-underreamed borehole is desired, the drilling assemblies disclosed herein may drill such a borehole without the need to return to the surface for resetting. While a hydraulic actuation mechanism and the benefits thereof have been described in detail, it should be understood by one of ordinary skill in the art that such a mechanism is not a required component of the drilling system disclosed herein. Alternatively, for certain circumstances, a simplified shear member activation mechanism may be used instead.

While preferred embodiments of this disclosure have been shown and described, modifications thereof may be made by one skilled in the art without departing from the spirit or teaching of this disclosure. The embodiments described herein are exemplary only and are not limiting. Many variations and modifications of the system and apparatus are possible and are within the scope of the disclosure. Accordingly, the scope of protection is not limited to the embodiments described herein, but is only limited by the claims which follow, the scope of which shall include all equivalents of the subject matter of the claims.

What is claimed:

1. An expandable drilling apparatus, comprising:

a main body comprising a central bore and at least one axial recess configured to receive an arm assembly operable between a retracted position and an extended position;

a biasing member to urge the arm assembly into the retracted position;

a drive piston configured to thrust the arm assembly into the extended position when in communication with drilling fluids in the central bore;

a flow switch integral to the main body and disposed between a distal end of the drilling apparatus and the arm assembly;

a selector piston translatable between an open position and a closed position, wherein the selector piston is thrust into the open position when a pressure of the drilling fluids exceeds an activation value;

wherein the drilling fluids are in communication with the drive piston when the selector piston is in the open position;

a selector spring configured to thrust the selector piston into the closed position when the pressure of the drilling fluids falls below a reset value.

2. The expandable drilling apparatus of claim 1, wherein the arm assembly translates along a plurality of grooves formed into walls of the axial recess.

3. The expandable drilling apparatus of claim 1, further comprising a cutting head adjacent to a distal end of the main body.

4. The expandable drilling apparatus of claim 3, wherein the cutting head comprises a drill bit.

5. The expandable drilling apparatus of claim 3, wherein the arm assembly is axially positioned behind the cutting head a distance between about one to about five times a diameter of the cutting head.

6. The expandable drilling apparatus of claim 1, wherein the arm assembly translates along a plurality of grooves formed on sides of the arm assembly.

7. The expandable drilling apparatus of claim 1, wherein the arm assembly comprises cutting elements configured to underream a pilot bore.

8. The expandable drilling apparatus of claim 1, wherein the arm assembly comprises a stabilizer portion.

9. The expandable drilling apparatus of claim 1, further comprising a shear member to retain the selector piston in the closed position.

10. The expandable drilling apparatus of claim 1, wherein the drilling assembly exhibits a first characteristic pressure drop profile when the selector piston is in the closed position and a second characteristic pressure drop profile when the selector piston is in the open position.

11. The expandable drilling apparatus of claim 10, further comprising an third characteristic pressure drop profile when the selector piston is in the open position and the arm assembly is in the extended position.

12. The expandable drilling apparatus of claim 1, wherein the main body is substantially tubular.

13. An expandable drilling apparatus connected to a drillstring, the drilling apparatus comprising:

a cutting head disposed upon a main body, wherein the main body comprises a plurality of axial recesses adjacent to the cutting head;

a plurality of arm assemblies retained within the axial recesses, wherein the arm assemblies are configured to translate from a retracted position to an extended position along a plurality of grooves formed into walls of the axial recesses;

a drive piston configured to thrust the arm assemblies into the extended position when in communication with fluids flowing through the drillstring; and a flow switch integral to the main body and disposed between a distal end of the drilling apparatus and the arm assembly;

a selector piston configured to allow fluids flowing through the drillstring to communicate with the drive piston when an activation pressure is exceeded.

14. The expandable drilling apparatus of claim 13, wherein the arm assemblies are axially positioned behind the cutting head a distance between one to five times a diameter of the cutting head.

15. The expandable drilling apparatus of claim 13, wherein the expandable drilling apparatus exhibits a first characteristic pressure drop profile when selector piston isolates fluids flowing through the drillstring from the drive piston, and a second characteristic pressure drop profile when the selector piston allows fluids flowing through the drillstring to communicate with the drive piston.

16. The expandable drilling apparatus of claim 15, wherein the expandable drilling apparatus exhibits a third characteristic pressure drop profile when the plurality of arm assemblies are in the extended position.

17. A method of drilling a borehole comprising:

disposing a drilling assembly having expandable arm assemblies adjacent to a cutting head upon a distal end of a drillstring;

providing a flow switch integral to a main body of the drilling assembly between a distal end of the drilling assembly and the arm assemblies, and selectively actuating the arm assemblies;

drilling a pilot bore with the cutting head;

underreaming the pilot bore with cutting elements of the expandable arm assemblies;

stabilizing the drilling assembly with stabilizer pads of the expandable arm assemblies.

18. The method of claim 17, further comprising:

retracting the expandable arm assemblies; and drilling the pilot bore with the expandable arm assemblies in a retracted position.

19. The method of claim 17, further comprising a flex joint member between the expandable arm assemblies and the drillstring.

20. The method of claim 19, further comprising using the cutting head and the expandable arm assemblies as a single fulcrum point in a directional drilling operation.

* * * * *